US012692772B2

(12) United States Patent
Cochran

(10) Patent No.: US 12,692,772 B2
(45) Date of Patent: Jul. 28, 2026

(54) COMPLETING A WELLBORE WITH MULTIPLE ELECTRICAL SUBMERSIBLE PUMP DOCKING STATIONS

(71) Applicant: Saudi Arabian Oil Company, Dhahran (SA)

(72) Inventor: Jamie Matthew Cochran, Inverurie (GB)

(73) Assignee: Saudi Arabian Oil Company, Dhahran (SA)

( * ) Notice: Subject to any disclaimer, the term of this patent is extended or adjusted under 35 U.S.C. 154(b) by 0 days.

(21) Appl. No.: 19/008,267

(22) Filed: Jan. 2, 2025

(65) Prior Publication Data

US 2026/0185430 A1 Jul. 2, 2026

(51) Int. Cl.
*E21B 43/12* (2006.01)
*E21B 17/02* (2006.01)

(52) U.S. Cl.
CPC ..... *E21B 43/128* (2013.01); *E21B 17/028* (2013.01)

(58) Field of Classification Search
CPC ..... E21B 43/128; E21B 23/02; E21B 23/03; E21B 43/122
See application file for complete search history.

(56) References Cited

U.S. PATENT DOCUMENTS 5,058,683 A 10/1991 Godfrey et al.
5,455,573 A 10/1995 Delatorre
6,167,965 B1 1/2001 Bearden et al.
7,640,993 B2 1/2010 Head
7,775,275 B2 8/2010 Patel
7,814,969 B2 10/2010 Shaw
9,166,352 B2 10/2015 Hansen
9,322,252 B2 4/2016 Head
9,627,862 B2 4/2017 Hytten et al.
10,396,540 B2 8/2019 Mangum
11,105,160 B2 8/2021 Leismer et al.
11,118,404 B2 9/2021 Leismer et al.
11,199,079 B2 12/2021 Tiwari
11,441,363 B2 9/2022 Bishop et al.
11,585,161 B2 2/2023 Wetzel
(Continued)

OTHER PUBLICATIONS

U.S. Appl. No. 19/008,060, Xiao et al., filed Jan. 2, 2025.
(Continued)

*Primary Examiner* — David Carroll
(74) *Attorney, Agent, or Firm* — Dinsmore & Shohl LLP

(57) ABSTRACT

Systems, assemblies, and methods for completing a wellbore. A wellbore completion assembly has a production tubing, a first nipple, a first electrical connection, a second nipple, and a second electrical connection. The first nipple is positioned at a first location in the production tubing. The first nipple defines a first nipple profile. The first electrical connection is positioned at the first location. The first electrical connection is configured to couple to a first electrical submersible pump assembly. The second nipple is positioned at a second location in the production tubing. The second location is different than the first location. The second nipple defines a second nipple profile different than the first nipple profile. The second electrical connection is positioned at the second location. The second electrical connection is configured to couple to a second electrical submersible pump assembly.

20 Claims, 12 Drawing Sheets

(56) References Cited

U.S. PATENT DOCUMENTS

| | | | | |
|---|---|---|---|---|
| 11,634,976 | B2 * | 4/2023 | Wetzel | E21B 43/128 166/382 |
| 2003/0085815 | A1 | 5/2003 | Tilton et al. | |
| 2006/0196668 | A1 * | 9/2006 | Burge | E21B 43/14 166/115 |
| 2007/0289740 | A1 | 12/2007 | Thigpen et al. | |
| 2008/0026623 | A1 | 1/2008 | Emerson et al. | |
| 2011/0011596 | A1 * | 1/2011 | Martinez | E21B 43/128 166/372 |
| 2011/0024104 | A1 | 2/2011 | Griffiths | |
| 2012/0118563 | A1 * | 5/2012 | Tetzlaff | E21B 43/128 166/242.6 |
| 2014/0020907 | A1 * | 1/2014 | Head | E21B 43/128 166/66.4 |
| 2018/0179860 | A1 | 6/2018 | McMullen et al. | |
| 2019/0292889 | A1 * | 9/2019 | Hansen | E21B 43/128 |
| 2020/0080388 | A1 * | 3/2020 | Leismer | E21B 17/023 |
| 2020/0300068 | A1 | 9/2020 | Shaw et al. | |
| 2020/0362867 | A1 | 11/2020 | Fox et al. | |
| 2021/0140247 | A1 * | 5/2021 | Bishop | E21B 17/028 |
| 2021/0189805 | A1 | 6/2021 | Beck et al. | |
| 2022/0200343 | A1 | 6/2022 | Pihl | |
| 2022/0268131 | A1 | 8/2022 | Alghamdi et al. | |
| 2023/0075553 | A1 | 3/2023 | Firth et al. | |
| 2023/0335943 | A1 | 10/2023 | Obermeyer et al. | |

OTHER PUBLICATIONS huntingplc.com [online], "Otis X Running Tool," available on or before Jul. 1, 2024, via Internet Archive: Wayback Machine URL<https://web.archive.org/web/20240701025936/https://cdn.sanity.io/files/bwa44qrg/production/9ac3f8726c85fcb0d3040d1b089b46fd7bedcbc0.pdf>, retrieved on Jan. 15, 2025, retrieved from URL<https://media.huntingplc.com/products-and-services/well-intervention-equipment/slickline-equipment/halliburton-oem-tools/hunting-otis-x-running-tool-datasheet.pdf>, 1 page.

Spagnolo et al., "First Successful Replacement of Fully Retrievable ESP by Slickline," Society of Petroleum Engineers, SPE-192839-MS, prepared for presentation at the Abu Dhabi International Petroleum Exhibition & Conference, Abu Dhabi, UAE, Nov. 12-15, 2018, pp. 1-13, 13 pages.

Vielma et al., "ESP Retrievable Technology: A Solution to Enhance ESP Production While Minimizing Costs," Society of Petroleum Engineers, SPE 156189, prepared for presentation at the SPE International Production and Operations Conferences, Doha, Qatar, May 14-16, 2012, pp. 1-14, 14 pages.

* cited by examiner

COMPLETING A WELLBORE WITH MULTIPLE ELECTRICAL SUBMERSIBLE PUMP DOCKING STATIONS

TECHNICAL FIELD

This disclosure relates to placing and powering an electrical submersible pump in a wellbore, for example, with a completion assembly with multiple different docking stations with different docking profiles for different electrical submersible pump assemblies.

BACKGROUND

Hydrocarbons are trapped in reservoirs in subterranean formations of the Earth. Wellbores are drilled through subterranean formations to access those reservoirs. A completion system with an electrical submersible pump can be placed in the wellbore to raise the hydrocarbons to the surface of the Earth. Sometimes, the electrical submersible pump or electrical connections to the electrical submersible pump can fail, halting production and requiring replacement of the completion system and electrical submersible pump to restore the wellbore to operation.

SUMMARY

This disclosure describes technologies related to placing and powering an electrical submersible pump in a wellbore. The wellbore is completed with a completion assembly which includes multiple different docking stations with different docking profiles. If one electrical submersible pump, electrical connection, or power cable fails, the failed electrical submersible pump can be removed and replaced with a different electrical submersible pump at the same location. If an electrical connection or power cable fails, a different electrical submersible pump can be placed at a second, different location. These replacement operations can be performed without replacing the entire production tubing because the different docking stations have different profiles, allowing selective placement of wellbore production components.

Implementations of the present disclosure can realize one or more of the following advantages. For example, this approach can reduce downtime required for completion assembly repairs. By installing multiple redundant electrical connections with different nipple profiles, another electrical connection is available to be used in the event of a failure of the previously used electrical connection, without requiring removal of the entire production tubing. For example, a failed electrical submersible pump can be changed out without using a drilling rig, and instead, can be changed out with a workover rig, slickline unit, wireline unit, or coiled tubing unit using established common well intervention techniques.

This approach can also improve the lifetime of the completion assembly in the wellbore. For example, by protecting the electrical connections from wellbore fluids within the production tubing, corrosion and damage of the electrical connections can be reduced, improving the lifetime of the electrical connections. For example, by providing multiple unused electrical connections for electrical submersible pumps, the overall lifetime of the completion assembly can be improved.

This approach can also improve completion assembly reliability. Reliability refers to the ability of a system to perform its intended function without failure, while redundancy refers to the use of backup components or systems to prevent or mitigate the consequences of a failure. For example, by placing multiple redundant electrical connections and protecting the unused electrical connections, the overall reliability of a system can be improved.

Implementations of the present disclosure can also provide flexibility for operators to optimize completion operations in a wellbore. For example, numerous permutations and configurations of completion components can be activated between one electrical connection and another electrical connection, which can be achieved by adding or removing a nipple lock and the associate seal components into or from selective completion nipples with selective profiles pre-installed with the completion assembly using a tubing well intervention conveyance.

Implementations of this present disclosure can also simplify work over operations performed on the wellbore. For example, the completion assembly and methods described here can eliminate the use of a tubing rig because an entire conventional production string no longer needs to be removed and replaced to restore production flow when a single electrical submersible pump fails in the conventional production string. Instead, using the completion assembly described in the present disclosure, a downhole conveyance such as a coiled tubing unit can remove and replace a failed electrical submersible pump assembly faster and more efficient, while the rest of completion assembly remains in place in the wellbore.

This approach can also enable testing of electrical connections. For example, by latching a test connector to the electrical connectors, proper functioning of all phases of the electrical system in the wellbore can be investigated. Electrical failures can be detected earlier.

This approach can also improve the cleanliness of downhole electrical connections. For example, sometimes debris can be deposited in the electrical connections or corrosion can build up in the electrical connections. Engaging and disengaging the test connector into and out of the electrical connectors can agitate the debris or corrosion can be agitated and cleared away from the electrical connections. In some cases, the resistance between the test connector and the electrical connections can be decreased, subsequently improving the electrical flow between the installed electrical submersible pump assembly and the downhole electrical connection and further increasing the useful lifetime of the completion assembly.

The details of one or more implementations of the subject matter described in this disclosure are set forth in the accompanying drawings and the description below. Other features, aspects, and advantages of the subject matter will become apparent from the description, the drawings, and the claims.

DETAILED DESCRIPTION

The present disclosure describes systems and methods for completing a wellbore. Sometimes, a completion assembly can be placed in the wellbore to pressurize and move fluids in the wellbore from a downhole location to an uphole location and onward to a surface of the Earth. The completion assembly has multiple electrical connections spaced apart at different locations so one or more electrical submersible pump assemblies can be selectively placed at one or more of the electrical connections by coupling the electrical submersible pump assembly to a different selective nipple at each location corresponding to each electrical connection in the completion assembly. The electrical submersible pump assembly can then flow the fluids from the formations into the wellbore and then up to the surface of the Earth. Sometimes, an electrical submersible pump assembly can fail and must be replaced to continue producing the subterranean formations. The failed electrical submersible pump assembly can be disconnected from the respective selective nipple and removed from the wellbore. Subsequently, another electrical submersible pump assembly can be placed at the same or a different selective nipple, and production operations can be resumed. These systems and methods can enable an efficient approach to producing fluids including hydrocarbons and water from a subterranean hydrocarbon reservoir into the wellbore, through the wellbore, and up to the surface of the Earth by using easily replaceable and selectively positionable electrical submersible pump assemblies placed in the pre-positioned electrical connections and selective nipples in the completion assembly.

The wellbore completion assembly includes a production tubing, a first nipple, a first electrical connection, a second nipple, and a second electrical connection. The first nipple is positioned at a first location in the production tubing and defines a first nipple profile. The first electrical connection is at the first location in the production tubing and is configured to couple to a first electrical submersible pump. The second nipple is positioned at a second location in the production tubing. The second location is different than the first location. The second nipple defines a second nipple profile which is different than the first nipple profile. The second electrical connection is positioned at the second location in the production tubing and is configured to couple to a second electrical submersible pump.

Figure 1:
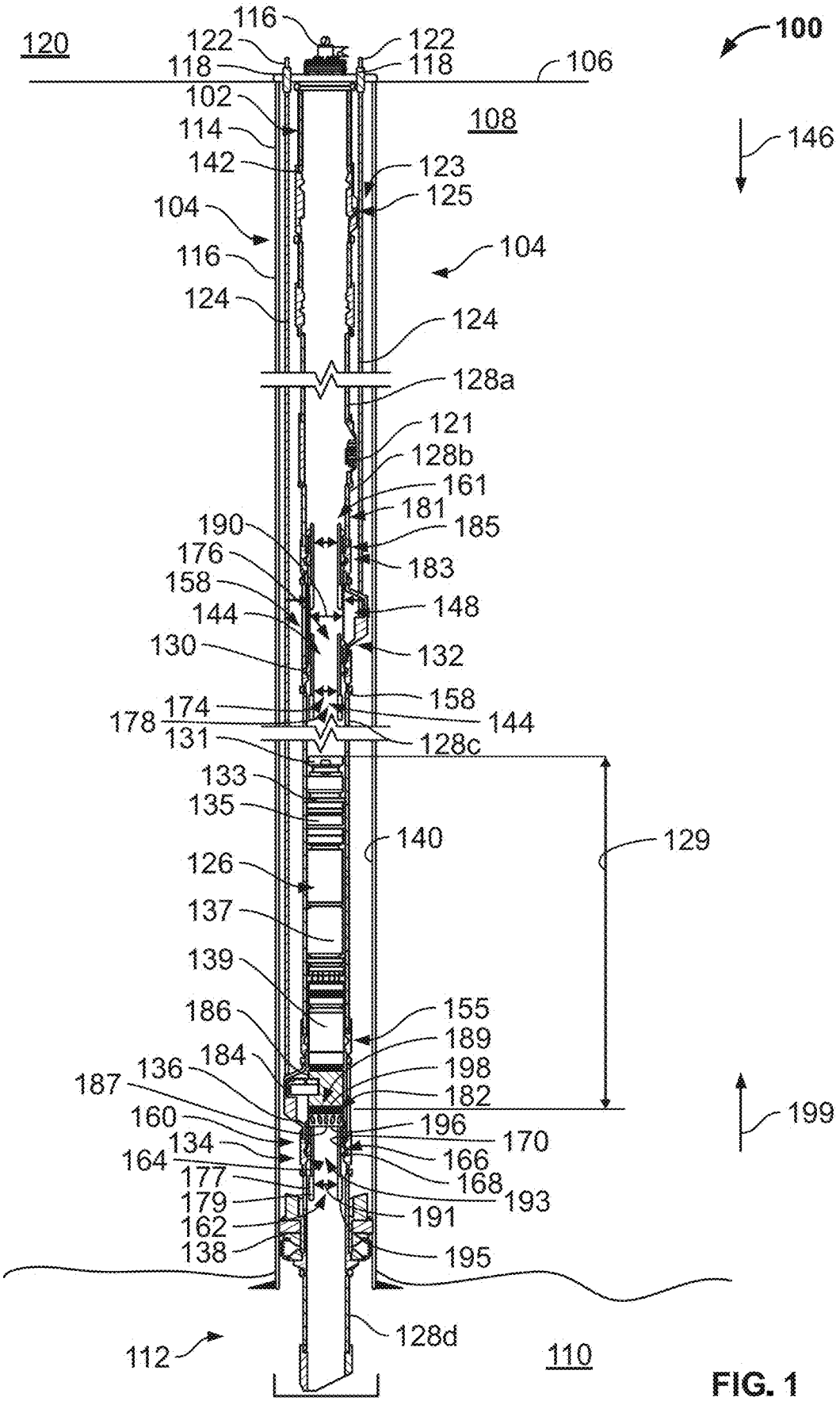
FIG. 1 is a schematic view of a completion assembly positioned in a wellbore.

FIG. 1 is a schematic view of a completion system 100 having a completion assembly 102 positioned in a wellbore 104. The wellbore 104 is drilled and cased from a surface 106 of the Earth through subterranean formations 108 to a hydrocarbon reservoir 110 containing fluids such as hydrocarbons, water, and other chemicals. The completion assembly 102 is positioned in the wellbore 104 and extends from the surface 106 to a downhole location 112 in the wellbore 104 that is open to fluids from the hydrocarbon reservoir 110. The completion assembly 102 is coupled to the wellbore 104. The completion assembly 102 conducts the fluids contained within the hydrocarbon reservoir 110 from the downhole location 112 to the surface 106 for production and refinement.

The completion system 100 includes a casing 114 positioned within the wellbore 104. The casing 114 can include one or more components or strings such as a conductor, a surface casing, an intermediate casing, a production string, a liner, and/or packers or shoes to couple the components to the subterranean formations 108. The casing 114 can include one or more of steel pipe and cement.

The completion system 100 has a wellhead assembly 116 with a Christmas tree positioned at the surface 106 of the Earth and coupled to the casing 114. The wellhead assembly 116 seals the fluids in the casing 114 and controls the flow of the fluids into and out of the wellbore 104. The completion assembly 102 is coupled to the wellhead assembly 116 at the surface 106. The wellhead assembly 116 has a tubing head and a tubing hanger to couple the completion assembly 102 to the wellhead assembly 116.

The wellhead assembly 116 has one or more power cable wellhead penetrators 118 extending from outside 120 the wellbore 104 into the wellbore 104 to pass electricity from surface power cables 122 outside 120 the wellbore 104 to downhole power cables 124 within the wellbore 104. The power cable wellhead penetrators 118 prevent fluids from the wellbore 104 from leaking through the wellhead assembly 116 to outside 120 the wellhead assembly 116. The downhole power cables 124 extend from the wellhead assembly 116 to electrically powered downhole components such as an electrical submersible pump assembly 126. In some cases, the downhole power cables 124 each have three cables to supply three-phase electrical power downhole. In some implementations, each downhole power cable 124 supplies power to only one downhole electrical connection (i.e., one of the electrical connection 132 or second electrical connection 136). In other implementations, a single downhole power cable 124 can supply power to multiple downhole electrical connections (i.e., both the first electrical connection 132 and the second electrical connection 136). Although the wellhead assembly 116 is shown as having two wellhead penetrators 118 and two downhole power cables 124, any number of wellhead penetrators 118 and downhole power cables 124 can be used.

The completion assembly 102 has multiple production tubing sections **128*a*-128*d*, a first nipple 130, a first electrical connection 132, a second nipple 134, a second electrical connection 136, and a production packer 138. The production tubing sections 128*a*-128*d*, the first nipple 130, the first electrical connection 132, the second nipple 134 (with a different internal shape than the first nipple 130), the second electrical connection 136, and the production packer 138 are coupled together sequentially extending from the surface 106 of the Earth to the downhole location 112 in the wellbore 104. The production tubing section 128*a* is coupled to the wellhead assembly 116. The production packer 138 is coupled to an inner surface 140 of the casing 114 and anchors the completion assembly 102 in the casing 114**.

The production tubing sections **128*a*-128*d* are coupled between the various components of the completion assembly 102 to space out and position the various components at pre-selected locations. The production tubing section 128*c*** spaces the first electrical connection 132 from the second electrical connection 136. In some implementations, the first electrical connection 132 is spaced apart from the second electrical connection 136 by a distance of at least fifty feet. In other implementations, the first electrical connection 132 is spaced apart from the second electrical connection 136 by a distance of between fifty and eighty feet. Sometimes, a typical length of the electrical submersible pump assembly 126 is fifty feet, so the production tubing section 128*c* provides a space for the entire electrical submersible pump assembly 126 between the first electrical connection 132 and the second electrical connection 136 with the first electrical connection 132 uphole from the electrical submersible pump assembly 126. In some implementations, the shortest length between the first and second electrical connections 132, 136 can be the total length of the electrical submersible pump assembly 126 and the length of the 148 (described below) so that the electrical submersible pump assembly 126 can be set in the second electrical connection 126 and a sleeve 148 covers the first electrical connection 132 without interference.

Each of the production tubing sections 128*a*-128*d* can include one or more production tubes coupled together. The production tubes can have an outer diameter corresponding to a standard American Petroleum Institute (API) pipe size. For example, the production tubes can have an outer diameter between ¾ inches and 5 inches, however, any acceptable pipe size can be used. The production tubes have a length. For example, in some implementations, the length of each of the production tubes can be between twenty and forty feet, however, any acceptable length of production tubes can be used.

Each of the production tubes has connectors 142 positioned at each end of the respective production tube. The connectors 142 couple the production tubing sections 128*a*-128*d* to the other components of the completion assembly 102. Additionally, the connectors 142 can be engaged by a downhole conveyance such as a coiled tubing assembly, a wireline assembly, or a slickline assembly so the respective production tubing section 128*a*-128*d* and any other components coupled to the respective production tubing section 128*a*-128*d* downhole from the respective production tubing section 128*a*-128*d* can be disposed in the wellbore 104 or retrieved from the wellbore 104. The connectors 142 can be a standard API (American Petroleum Institute) pin connection or a manufacturer proprietary design. For example, the connectors 142 can be any type of rotary shouldered connections such as box and pin connectors, regular connections, numeric connections, internal flush connections, or full hole connections. In other implementations, the connectors 142 can be a box connection, where the threads are internal to the box. Each of the connectors 142 can be the same or different. The connectors 142 can be threaded to rotatably couple to the other components of the completion assembly 102.

The first nipple 130 is positioned at a first location 158 in the completion assembly 102 in a downhole direction 146 away from the surface 106. The first nipple 130 is coupled to the production tubing section 128*b* and the production tubing section 128*c* between the production tubing section 128*b* and the production tubing section 128*c*. The first nipple 130 is configured to selectively receive and couple to a first nipple lock 144 of the completion assembly 102. When the first nipple lock 144 is disposed in the wellbore 104 and positioned at the first location 158 by downhole conveyance, the first nipple lock 144 is engaged to the first nipple 130. The first nipple lock 144 can be run on a running tool (i.e., on a running tool coupled to a wireline assembly) which temporarily engages an internal fishing profile of the first nipple lock 144, and is set at the desired location. The running tool is then retrieved using the wireline assembly. The first nipple lock 144 can then be retrieved at a later time using a pulling tool that also engages in the internal fishing profile. The first nipple lock 144 is configured to then receive and couple to additional completion assembly 102 components such as an additional electrical submersible pump (not shown) or a sleeve 148 (described below in more detail). The downhole conveyance can include a running tool that is selectively engaged to the first nipple lock 144 by the operator.

The first nipple 130 has an inner surface 150 defining a first nipple profile 152. The first nipple lock 144 has an outer surface 154 defining a first outer nipple profile 156. The first nipple profile 152 and the first outer nipple profile 156 correspond to each other and are keyed to selectively mate and engage to one another to couple the first nipple lock 144 to the first nipple 130. The first nipple profile 152 and the first outer nipple profile 156 include various arrangements and dimensions of unique shapes that mirror one another on the other paired component so the first nipple lock 144 can only engage the first nipple 130, and not engage to other components placed in the completion assembly 102. Further details of the first nipple lock 144 are described below. The first nipple profile 152 has an internal profile on the internal diameter (i.e., a cut away shape 360 degrees on the bore) and a polished seal bore of smaller inner diameter than the respective production tubing sections 128*a*-128*d* drift.

The first nipple 130 can be a commercially available nipple. For example, the first nipple 130 can be an "Otis" style X nipple or XN nipple, a "R" type nipple, or any other type of commercially available nipple. Alternatively, the first nipple 130 can be a proprietary design profiled nipple.

The first nipple lock 144 has a cylinder 172 defining a void 174 extending through the interior of the cylinder 172. The void 174 has an inner diameter 197. The first nipple lock 144 has an uphole end 176 and a downhole end 178. Production fluids and other production components or production tools can move through the void 174 to and from the surface 106 between the uphole end 176 and the downhole end 178. The first outer nipple profile 156 is defined in an outer surface 180 of the cylinder 172.

The uphole end 176 and the downhole end 178 of the first nipple lock 144 are configured to engage and hold the sleeve 148 in place when the sleeve 148 is positioned at the first location 158 in the completion assembly 102. The first nipple lock 144 can seal to the sleeve 148 to inhibit or prevent the production fluids within the completion assembly 102 from contacting the first electrical connection 132. The first nipple lock 144 has an outer diameter 188 with a seal bore that is a smaller diameter than an inner diameter 190 of the sleeve 148. A packing 192 of the first nipple lock 144 and the outer diameter 188 of the first nipple lock 144 engages the inner diameter 190 of the sleeve 148 and the packing 192, sealing the first nipple lock 144 to the sleeve 148. The packing 192 can be a multiple stack of chevron type elastomeric seals and backup rings. In some implementations, the packing 192 can include swellable elastomers. For example, swellable elastomers bay be used in circumstances such as when the first nipple lock 144 is worn or damaged.

The first nipple lock 144 has a removal profile configured to receive a retrieval tool. The retrieval tool can then remove the first nipple lock 144 from the completion assembly 102.

In some cases, the removal profile is a fish neck feature. The removal profile is positioned at the top of the internal bore of the first nipple lock 144.

The first nipple lock 144 can be a non-selective type (i.e., without a no-go inner diameter restriction). In this implementation, the nipple lock with the no-go inner diameter is set the deepest in the wellbore 104.

The second nipple 134 is positioned at a second location 160 in the completion assembly 102. The second location 160 is different than and spaced apart from the first location 158. The second nipple 134 is separated from the first nipple 130 at the first location 158 by the production tubing section 128*c*, the first electrical connection 132, and the second electrical connection 136. The second location 160 is in the downhole direction 146 from the first location 158.

The second nipple 134 is configured to selectively receive and couple to a second nipple lock 162 of the completion assembly 102. When the second nipple lock 162 is disposed in the wellbore 104 and positioned at the second location 160 by downhole conveyance, the second nipple lock 162 is engaged to the second nipple 134. The second nipple lock 162 is configured to then receive and couple to additional completion assembly 102 components such as the first electrical submersible pump assembly 126 (as shown in this implementation), the sleeve 148 if desired by the operator in an alternative configuration, or some other production component.

The second nipple 134 has an inner surface 164 defining a second nipple profile 166. The second nipple lock 162 has an outer surface 168 defining a second outer nipple profile 170. The second nipple profile 166 is different than the first nipple profile 152 and likewise, the second outer nipple profile 170 is different than the first outer nipple profile 156. The second nipple profile 166 and the second outer nipple profile 170 correspond to each other and are keyed to selectively mate and engage to one another to couple the second nipple lock 162 to the second nipple 134. The second nipple profile 166 and the second outer nipple profile 170 include various arrangements and dimensions of different shapes that are unique and also mirror one another on the paired component so the second nipple lock 162 can only engage the second nipple 134, and not engage to other components placed in the completion assembly 102.

The second nipple 134 can be a commercially available nipple. For example, the first nipple 130 can be an "Otis" style X nipple or XN nipple, or any other type of commercially available nipple. Alternatively, the second nipple 134 can be a proprietary design profiled nipple. However, the second nipple 134 is different than the first nipple 130 because the second nipple profile 166 is different than the first nipple profile 152 and likewise, the second outer nipple profile 170 is different than the first outer nipple profile 156 so the position of the first and second nipple locks 144, 162 cannot be switched in the completion assembly 102.

The second nipple lock 162 has a cylinder 195 defining a void 193 extending through the interior of the cylinder 195. The void 193 has an inner diameter 191. The second nipple lock 162 is the last and closer to the downhole location 112 than any other nipple lock in the completion assembly 102. The last nipple lock, which in this implementation is the second nipple lock 162, some or all of the inner diameter 191 is less than all the other inner diameters (such as inner diameter 197). In some cases, the last, smallest inner diameter 191 is a no-go diameter. All the other inner diameters of the nipple locks, such as the first nipple lock 144, have inner diameters 197 equal to or greater than any of the other inner diameters of the completion assembly 102.

The second nipple lock 162 has an uphole end 189 which is oriented toward the surface 106 and the downhole end 187 which is oriented toward the downhole location 112 in the hydrocarbon reservoir 110 (away from the surface 106). Production fluids and other production components or production tools can move through the void 174 of the second nipple lock 162 to and from the surface 106 between the uphole end 176 and the downhole end 178. The second outer nipple profile 170 is defined in the outer surface 180 of the cylinder 172 of the second nipple lock 162. The second nipple lock 162 has another packing 179 (similar to packing 192) to seal the second nipple lock 162 against an inner surface 177 of the completion assembly 102.

The second nipple lock 162 has a landing profile 182 to receive the electrical submersible pump assembly 126 and hold the electrical submersible pump assembly 126 at the second location 160 in the completion assembly 102 relative to the second electrical connection 136. The uphole end 176 of the second nipple lock 162 is configured to couple to the landing profile 182. The landing profile 182 can be threadedly coupled to the respective production tubing sections 128*a*-128*d*. The second nipple lock 162 is threadedly coupled to the electrical submersible pump assembly 126. The landing profile 182 can be removed from the second nipple lock 162. The landing profile 182 is a bore restriction that locks into the second nipple lock 162 below (in the downhole direction 146) the second electrical connection 136. In some implementations, the landing profile 182 can interface with a plug arm 184 of a retrievable shuttle motor connector 186 of the electrical submersible pump assembly 126 when the plug arm 184 lands on the landing profile 182 and activates the plug arm 184.

The second nipple lock 162 has multiple annular flow ports 194 extending between a first surface 196 (an inner lower surface of the landing profile 182) and a second surface 198 (an outer upper surface of the landing profile 182). The annular flow ports 194 pass the fluid within the completion assembly 102 through the second nipple lock 162 from the first surface 196 within the second nipple lock 162 to the second surface 198 outside the second nipple lock 162. When the electrical submersible pump assembly 126 is placed in and coupled to the completion assembly 102, the wellbore fluids passing through the annular flow ports 194 in an uphole direction 199 (opposite the downhole direction 146, toward the surface 106) flow into the retrievable shuttle motor connector 186 and through the electrical submersible pump assembly 126 to the surface 106. In some implementations, the annular flow ports 194 have an oval, circular cross-section, or a varying cross-section. The annular flow ports 194 can have the same or different diameters. In some implementations, the annular flow ports 194 are a single port. In some implementations, the annular flow ports 194 include multiple annular flow ports 194 positioned around the circumference of the second nipple lock 162. For example, there can be between one and fifteen, or even more annular flow ports 194. The annular flow ports 194 can be angled prevent tangential flow being directly onto the production tubing sections 128*a*-128*d* and potentially creating erosion of the production tubing sections 128*a*-128*d*. The annular flow ports 194 can be designed and optimized using computational fluid dynamics to reduce back pressure and erosional effects of the production tubing sections 128*a*-128*d*.

The completion assembly 102 has a third nipple 185 positioned at a third location 183 and a third nipple lock 181 configured to selectively couple to the third nipple 185. The third nipple 185 is spaced apart from the first nipple 144 and separated from the first nipple 144 by the first electrical connection 132. The third nipple 185 is uphole from the first electrical connection 132 and proximal to the first electrical connection 132. The third nipple 185 is coupled to the production tubing section 128*b*. The third nipple lock 181 and the first nipple lock 144 hold the sleeve 148 in position to seal the first electrical connection 132 from fluids within the completion assembly 102.

The third nipple 185 defines a third nipple profile 175. The third nipple 185 is configured to selectively receive and couple to the third nipple lock 181. When the third nipple lock 181 is disposed in the wellbore 104 by the downhole conveyance and positioned at the third location 183 by the downhole conveyance, the third nipple lock 181 is engaged to the third nipple 185. The third nipple 185 has an inner surface 173 defining the third nipple profile 175. The third nipple lock 181 has an outer surface 171 defining a third outer nipple profile 169. The third nipple profile 175 and the third outer nipple profile 169 correspond to each other and are keyed to selectively mate and engage to one another to couple the third nipple lock 181 to the third nipple 185. The third nipple profile 175 and the third outer nipple profile 169 include various arrangements and dimensions of different unique shapes that mirror one another on the paired component so the third nipple lock 181 can only engage the third nipple 185, and not engage to other components placed in the completion assembly 102. The third nipple profile 175 is different than the first nipple profile 152 and the second nipple profile 166. Likewise, the third outer nipple profile 169 is different than both the first outer nipple profile 156 and the second outer nipple profile 170.

The third nipple lock 181 has a cylinder 167 defining a void 165 extending through the cylinder 167. The void 165 has an inner diameter 163. The third nipple lock 181 has an uphole end 161 and a downhole end 159. Production fluids and other production components or production tools can move through the void 165 to and from the surface 106 between the uphole end 161 and the downhole end 159. The third outer nipple profile 169 is defined in an outer surface 157 of the cylinder 167.

The third nipple 185 can be a commercially available nipple. For example, the third nipple 185 can be an "Otis" style X nipple or XN nipple, or any other type of commercially available nipple. Alternatively, the third nipple 185 can be a proprietary design profiled nipple.

The downhole end 159 of the third nipple lock 181 engages to and holds the sleeve 148 in place when the sleeve 148 is positioned at the first location 158 in the completion assembly 102. The first nipple lock 144 and the third nipple lock 181 seal to first and third nipples 144, 185 respectively, along with the sleeve 148 to inhibit or prevent production fluids within the completion assembly 102 from contacting the first electrical connection 132. The third nipple lock 181 has an outer diameter 119 with a seal bore that is a smaller diameter than the inner diameter 190 of the sleeve 148. Another packing 192 of the third nipple lock 181 and the outer diameter 119 of the third nipple lock 181 engage the inner diameter 190 of the sleeve 148 and the packing 192 and seals the third nipple lock 181 to the sleeve 148.

In some cases, the first nipple lock 144, the sleeve 148, and third nipple lock 181 are coupled together at the surface 106 and positioned in the completion assembly 102 at the respective first and third locations 158, 183, sealing the first electrical connection 132 in a single run. In other implementations, the first nipple lock 144 can be placed at the first location 158 in one run, and then the sleeve 148 and the third nipple lock 181 can be coupled together at the surface 106 and disposed together in the completion assembly 102 to be positioned at the third location 183 in another run, sealing the first electrical connection 132 in the second run. In other implementations, the first nipple lock 144 can be coupled together with the sleeve 148 and be placed at the first location 158 in one run, and then the third nipple lock 181 is disposed in the completion assembly 102 and coupled to the sleeve 148 when the third nipple lock 181 is at the third location 183 and engaged to the third nipple 185, sealing the first electrical connection 132 from the fluids in the completion assembly 102, in another example of a two run operation. In yet another implementation, each of the first nipple lock 144, the sleeve 148, and third nipple lock 181 can each be placed in the completion assembly 102 in separate runs.

The completion assembly 102 includes a fourth nipple 155 coupled between the second electrical connection 136 and the production tubing section 128*c*. The fourth nipple 155 is generally similar to the first, second, and third nipples 130, 134, and 185. The fourth nipple 155 has a fourth nipple profile 153 which is configured to selectively receive and couple to a fourth nipple lock, not shown, which is not used in the illustrated implementation. The fourth nipple profile 153 is different than the first, second, and third nipple profiles 152, 166, and 175. When the electrical submersible pump assembly 126 is coupled to the second electrical connection 136, placement of the fourth nipple lock at the fourth nipple 155 is unnecessary. However, when the operator desires to couple the electrical submersible pump assembly 126 to the first electrical connection 132, the first nipple lock 144, the sleeve 148, and the third nipple lock 181 can first be coupled to the second and fourth nipples 134, 155 to protect the second electrical connection 136. Alternatively, two electrical submersible pump assemblies 126 can be placed in the completion assembly 102. In yet another implementation, two sets of first nipple locks 144, sleeves 148, and third nipple locks 181 can be used, with each set sealing the first and second electrical connections 132, 136. Although only two electrical connections 132, 136 are described herein, one or more additional electrical connections and associated nipple locks may be used in the completion assembly 102 to improve redundancy and increase the useful life of the completion assembly 102 as desired by the operator.

The sleeve 148 protects the electrical connections 132, 136 from fluids within the completion assembly 102 when the sleeve 148 is placed by the downhole conveyance and sealed to the inner surface 140 by the first nipple lock 144 and the third nipple lock 181. The sleeve 148 is a hollow cylinder with an inner surface 151 defined by the inner diameter 190 and an outer surface 149 defined by an outer diameter 147. Portions of the outer surface 149 can contact the third nipple 185 to seal the sleeve 148 to the third nipple lock 181. In some implementations, the outer surface 149 is a polished outer bore. The outer surface 149 can create a good seal when it fits inside the packing 192 (a female portion) in the internal bore of the corresponding receptacle (the third nipple lock 181).

Figure 2A:
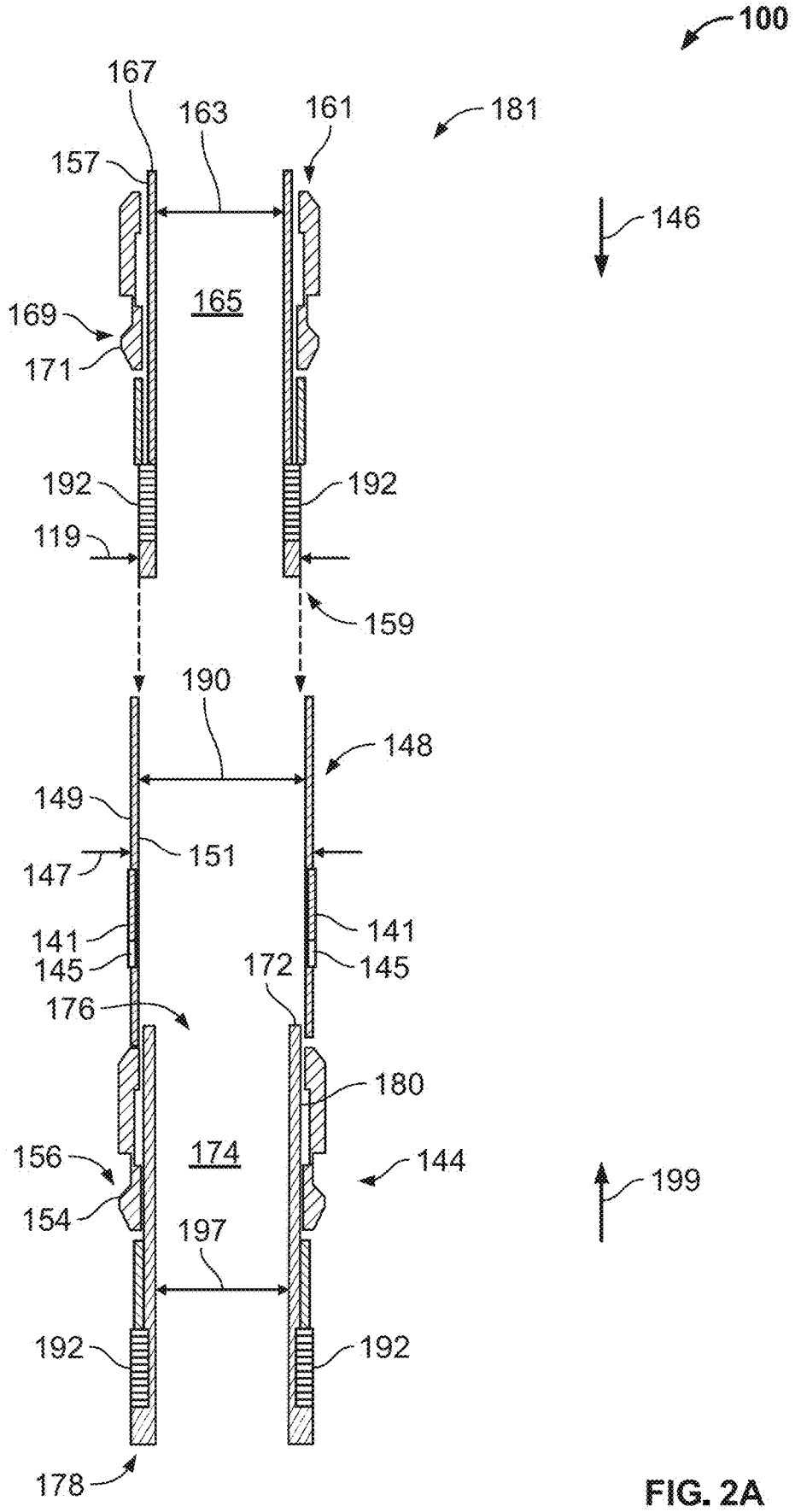
FIGS. 2A-2C are schematic views of a first electrical connection of the completion assembly of FIG. 1.
Figure 2B:
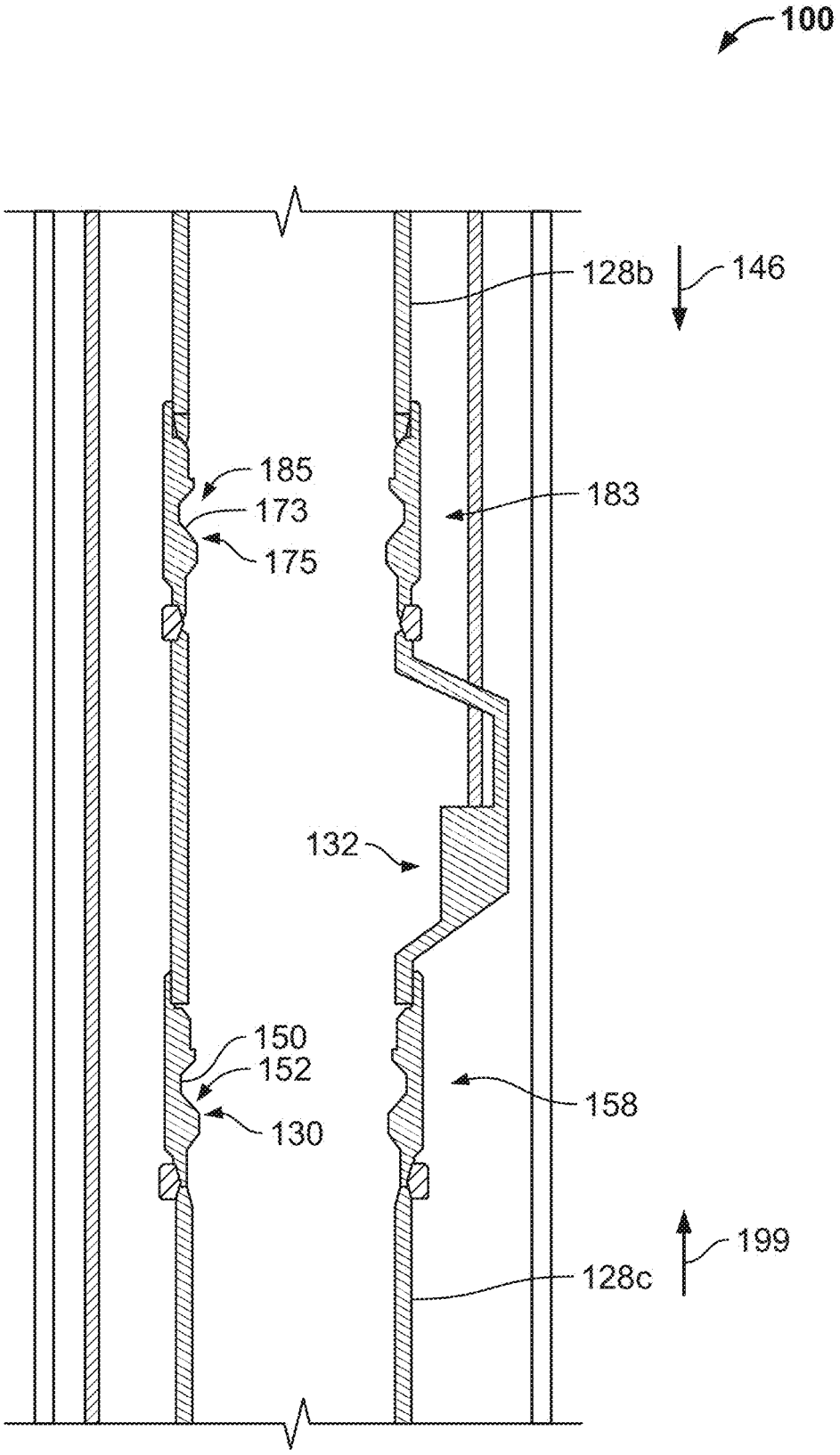
Figure 2C:
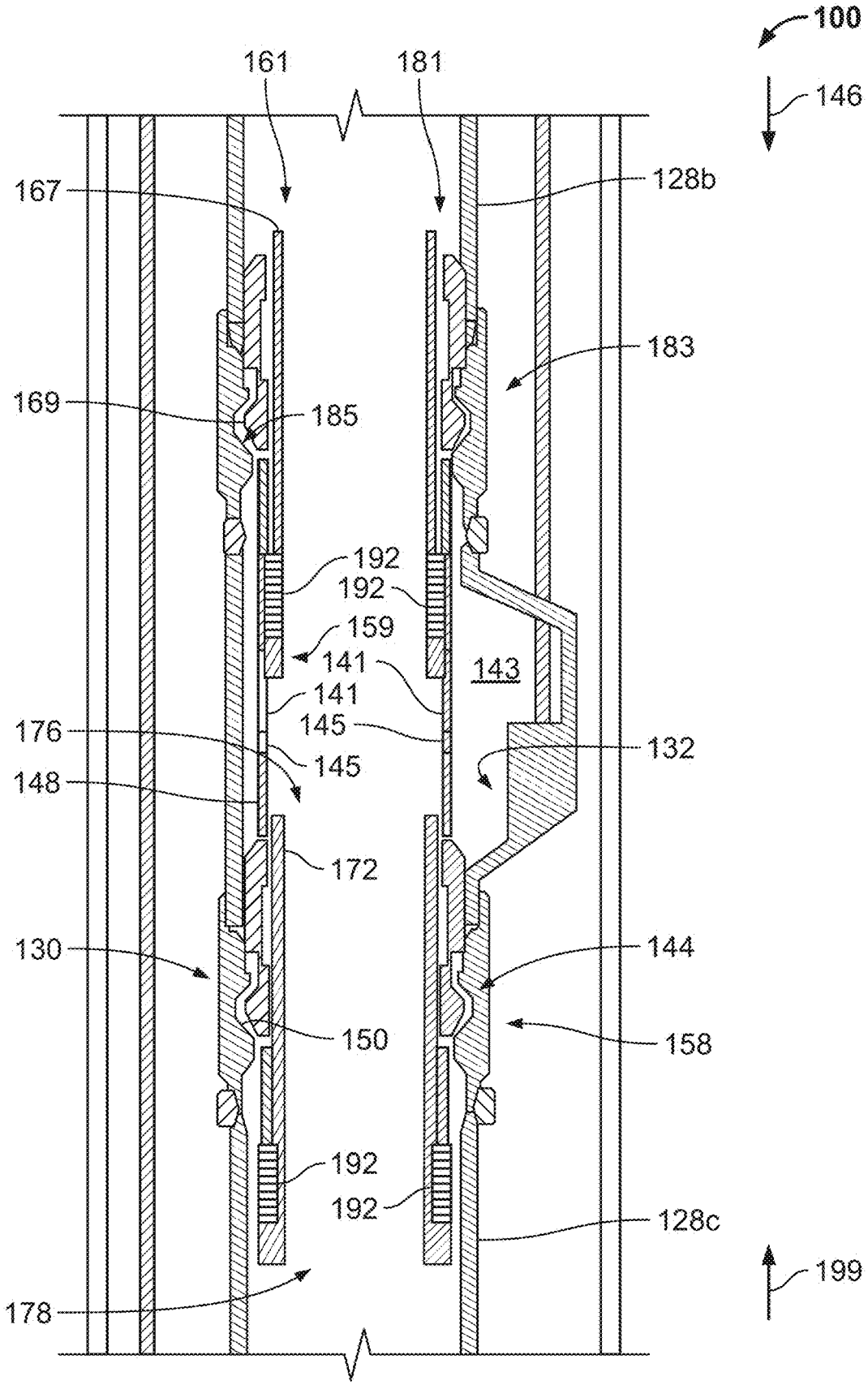
Figure 3A:
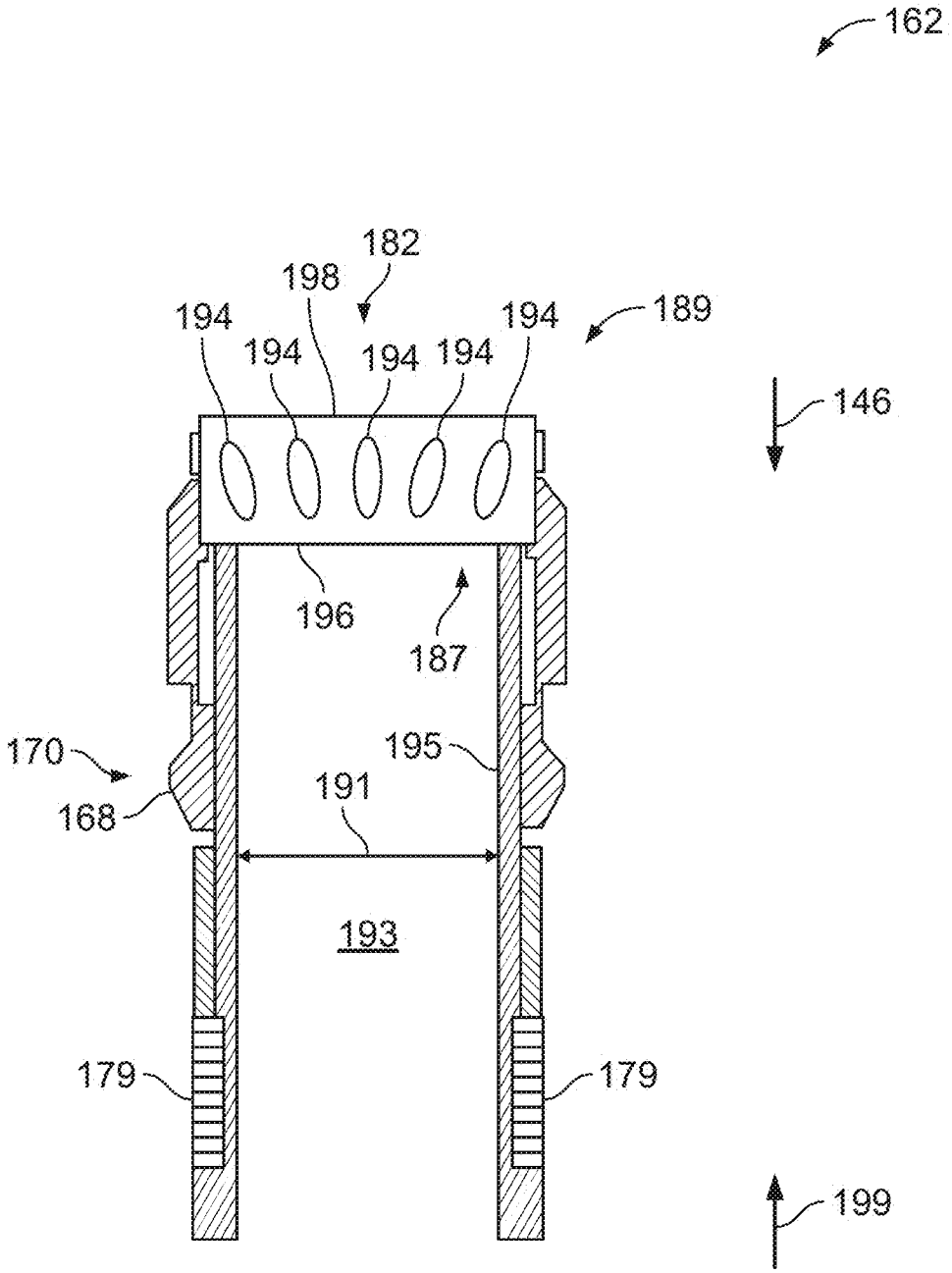
FIGS. 3A-3C are schematic views of a second electrical connection of the completion assembly of FIG. 1.
Figure 3B:
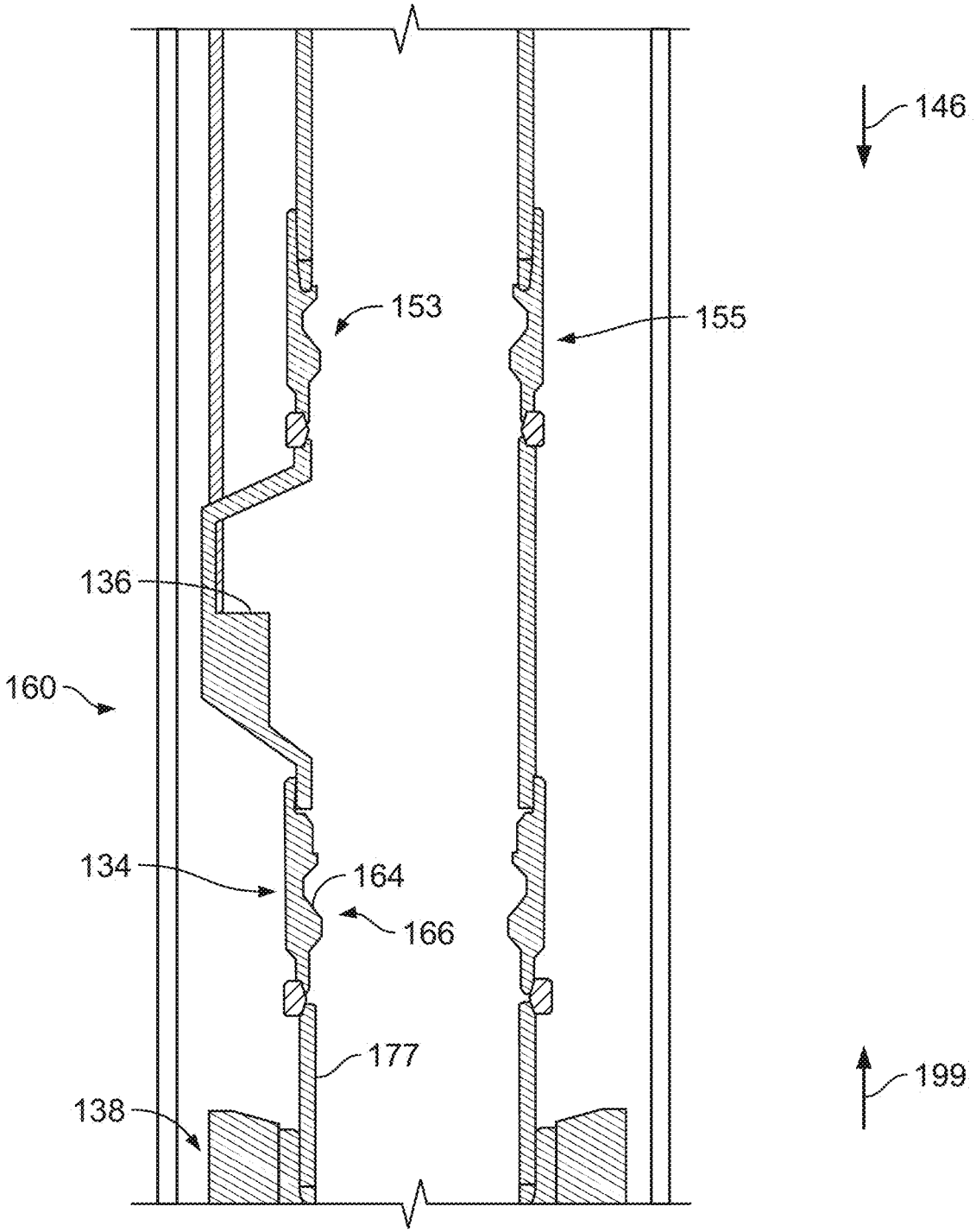
Figure 3C:
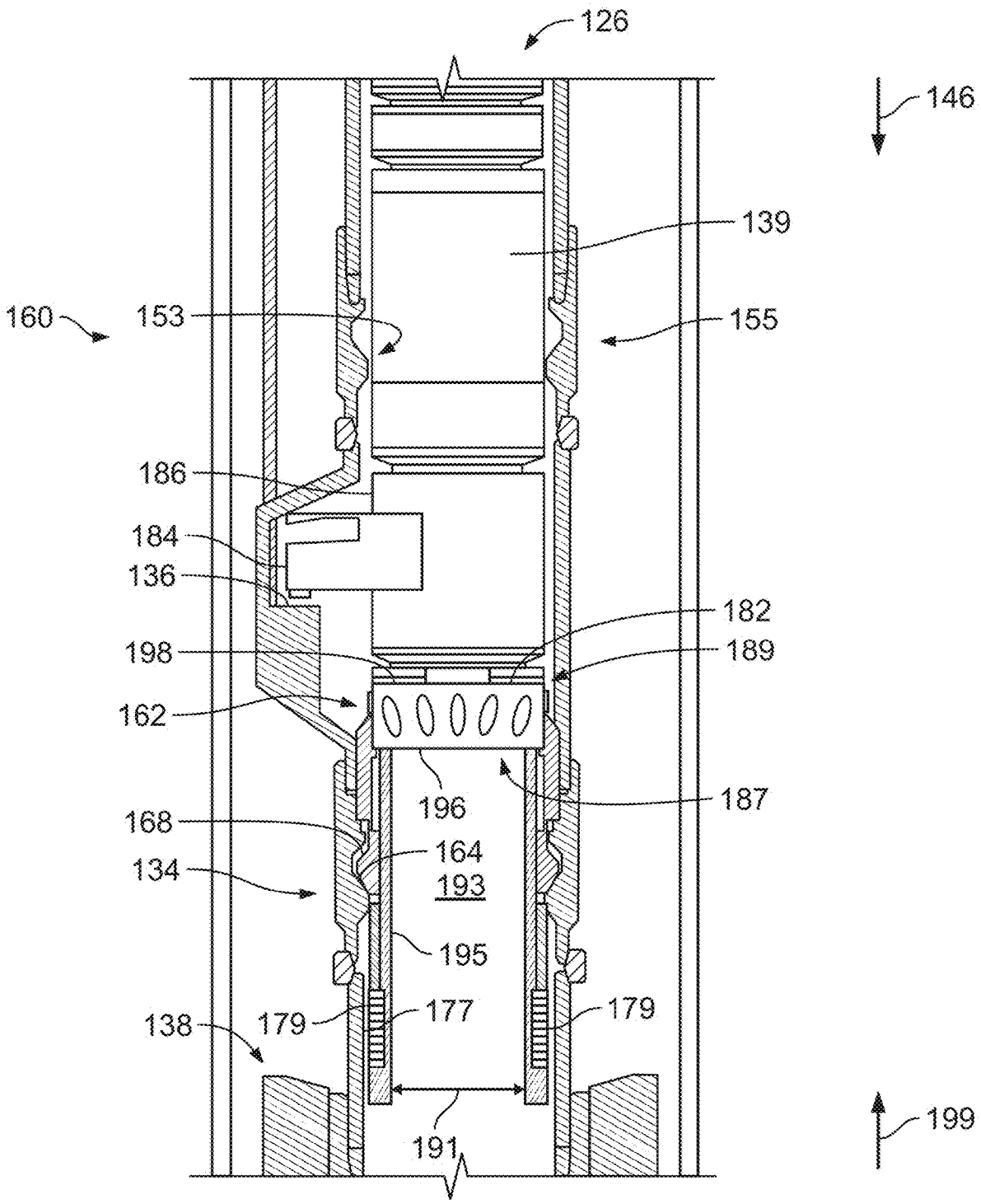

The sleeve 148 includes a corrosion protector 145 to reduce corrosion of the first and second electrical connections 132, 136. When the sleeve 148 is coupled to the completion assembly 102, a void 143, shown in FIG. 2C, is formed by the sleeve 148, the first nipple lock 144, and the third nipple lock 181, and in this implementation, the first electrical connection 132. Sometimes, fluids can remain in the void 143 after sealing the first electrical connection 132 or fluids may leak by the sleeve 148 into the void 143. In some cases, the fluids can include corrosive chemicals or cause the portions of the first electrical connection 132 to corrode, reducing the useful life of the first electrical connection 132. The corrosion protector 145 can reduce a level or a rate of corrosion of the first electrical connection 132, which increases equipment reliability and life expectancy of the completion assembly 102, allowing the completion assembly 102 to continue producing fluids from the hydrocarbon reservoir 110 to the surface 106. The corrosion protector 145 can be a galvanic anode, an impressed current cathodic protection device, a hydrogen sulfide neutralizer, or a dissolvable metal alloy container containing a liquid inhibitor where the dissolvable metal alloy container is dissolvable after a time duration, thus releasing the liquid inhibitor into the void 143. The corrosion protector 145 can be incorporated into the outer surface 149 of the sleeve 148 to place the corrosion protector 145 in the void 143.

The sleeve 148 includes a thermal compensation device 141 to compensate for temperature expansion and contraction of a trapped volume of fluid in the void 143. For example, the thermal compensation device 141 can be a gas filled bladder, a collapsible solid portion with syntactic spheres, or a moving pressure balanced piston to adjust the sleeve 148 based on a change in temperature of the sleeve 148. The thermal compensation device 141 can be incorporated into the outer surface 149 of the sleeve 148 to place the thermal compensation device 141 in the void 143.

The first and second electrical connections 132, 136 are configured to couple to an electrical submersible pump assembly, for example to the first electrical submersible pump assembly 126 or to the second electrical submersible pump assembly. The first and second electrical connections 132, 136 receive electrical power from the downhole power cables 124 and supply the electrical power to the first electrical submersible pump assembly 126. In some cases, the electrical connections 132, 136 are wet connect receptacles. In other implementations, the electrical connections 132, 136 are shuttle docking stations. In some implementations, the electrical connections 132, 136 are side pocket mandrels so the plug arm 184 of the retrievable shuttle motor connector 186 can translate into the void 143 to contact the electrical connections 132, 136.

The electrical submersible pump assembly 126 increases a pressure of the fluids from the hydrocarbon reservoir 110 and flows the fluids from the void 193 of the second nipple lock 162, through the electrical submersible pump assembly 126, and through the completion assembly 102 up to the surface 106 in the uphole direction 199. In this implementation, the electrical submersible pump assembly 126 includes the retrievable shuttle motor connector 186, a motor 139, a pump 137, a check valve 135, a packoff sub-assembly (packer) 133, and a tubing stop 131. However, any suitable electrical submersible pump assembly may be used.

The electrical submersible pump assembly 126 has an overall length 129 of between fifty and eighty feet. The overall length 129 of the electrical submersible pump assembly 126 is less than the distance 127 between the first location 158 of the first electrical connection 132 and the second location 160 of the second electrical connection 136.

The completion assembly 102 includes a surface controlled subsurface safety valve 125 to reduce a pressure within the completion assembly 102. The surface controlled subsurface safety valve 125 can automatically or responsive to an operator generated command signal, vent fluid from within the completion assembly 102 into an annulus 123 which is defined by the completion assembly 102 and the wellbore 104 to protect the completion assembly 102 from an overpressure condition.

The completion assembly 102 includes a permanent gauge 121 to sense a condition of the completion assembly 102 or the wellbore 104. The permanent gauge 121 can transmit a signal representing a value of the condition to an operator. Based on the value of the condition of the completion assembly 102 or the wellbore 104, the operator can determine the condition of the completion assembly 102 or the wellbore 104. For example, the condition of the completion assembly 102 or the wellbore 104 can be a pressure or a temperature.

Figure 4A:
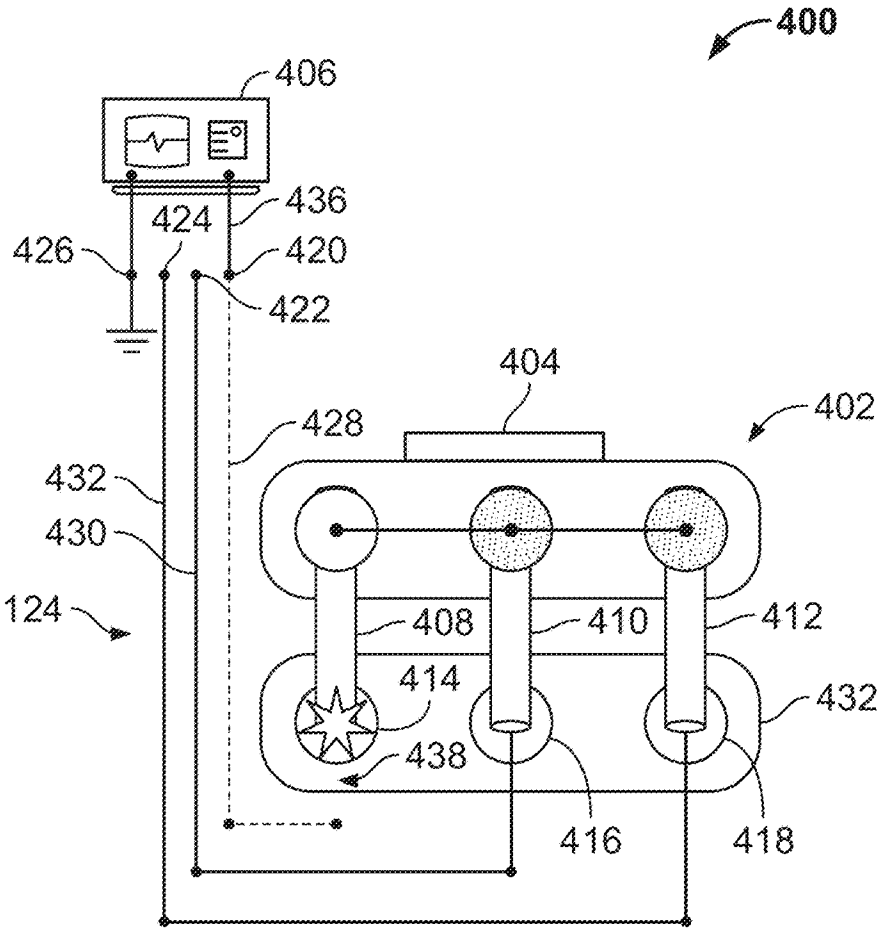
FIGS. 4A-4B are schematic views of a side pocket mandrel electrical test tool for testing electrical connections of the completion assembly of FIG. 1.
Figure 4B:
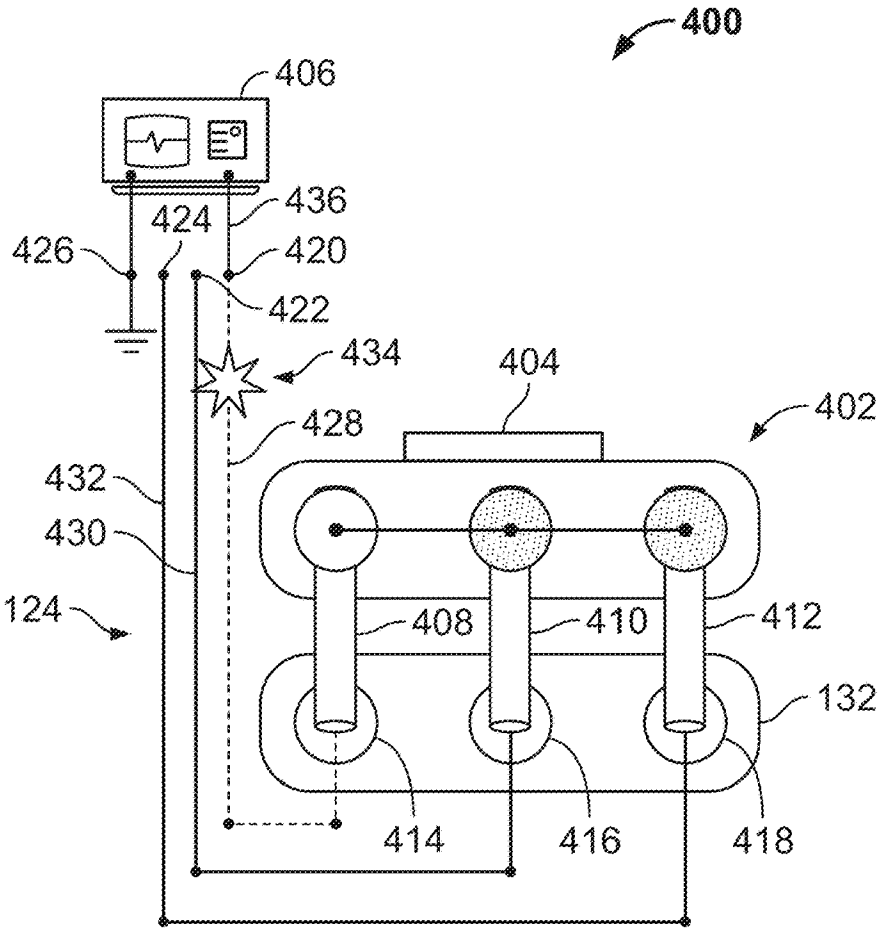

Referring to FIGS. 1 and 4A-4B, sometimes, one or more of the electrical components in the completion assembly 102 can fail. For example, one or more of the three cables of each of the downhole power cables 124 or one or more of the first and second electrical connections 132, 136 can experience a short or an open. For example, the motor 139 of the electrical submersible pump assembly 126 or the permanent gauge 121 can experience a short or an open. The operator may desire to determine which component failed without removing the entire completion assembly 102 from the wellbore 104. Or, before installing a new electrical submersible pump assembly 126 in the completion assembly 102, the operator may want to confirm proper operation of the downhole power cables 124 or one or more of the first and second electrical connections 132, 136.

The operator can couple a side pocket mandrel electrical test tool 400 to either the first electrical connection 132 or the second electrical connection 136 to test the respective downhole power cable 124 and first or second electrical connection 132, 136. The operator can dispose the side pocket mandrel electrical test tool 200 using the downhole conveyance. FIGS. 4A-4B are described in reference to the first electrical connection 132, however, the side pocket mandrel electrical test tool 400 can be used to test any of the electrical connections described here.

The side pocket mandrel electrical test tool 400 includes a common jumper lead 402, a running tool connector 404 coupled to the common jumper lead 402, and a controller 406. The controller 406 is electrically coupled to the common jumper lead 402 by the electrical component to be tested.

The running tool connector 404 couples to the downhole conveyance so the downhole conveyance can position the common jumper lead 402 in the completion assembly 102 and couple the common jumper lead 402 to the first electrical connection 132. The running tool connector 404 can be a threaded connector like connectors 142, or a profiled connector that a running tool can engage.

The common jumper lead 402 couples to the first electrical connection 132 to test the electrical properties of the respective downhole power cable 124 and first or second electrical connection 132, 136. For example, the continuity, resistance, insulation, time-domain reflectometry, type of fault, and location of the fault can be determined. The common jumper lead 402 has connector pins 408, 410, and 412 which each contact one of sockets 414, 416, 418 of the first electrical connection 132. The sockets 414, 416, 418 of the first electrical connection 132 are each connected to a single cable of the three cables 428, 430, 432 of the respective downhole power cable 124. The common jumper lead 402 connects with (i.e., short circuits) the downhole power cable 124 phases together so the controller can determine the continuity, resistance, and insulation between the phases or to ground 426 (the casing 114). The connector pins 408, 410, and 412 are electrically couped to one another by the common jumper lead 402.

The controller 406 is positioned at the surface 106 and electrically connects to test pins 420, 422, 424 for each individual cable of the three phase downhole power cable 124. Thus, the controller 406 is electrically coupled to the common jumper lead 402 by the downhole power cable 124 and the first electrical connection 132. The controller 406 can include a diagnostic meter. In some implementations, the controller 406 can be implemented as a computer system including one or more processors and a computer-readable medium storing computer instructions executable by the one or more processors to perform operations including determining the condition of the downhole power cable 124 and the first electrical connection 132. The controller 406 is selectively connected to each of the test pins 420, 422, 424 to determine the condition of each phase individually. The controller 406 has a test lead 436 which the operator can reposition to contact each of the test pins 420, 422, 424 one at a time to determine the condition of each cable 428, 430, 432.

The controller 406 determines a condition of the first electrical connection 132 and/or the downhole power cable 124 based on the condition of the common jumper lead 402. The controller 406 determines the electrical properties before and after the common jumper lead 402 contacts the first electrical connection 132, and then compares the properties to determine the type and location of the fault.

Referring to FIG. 4A, the cable 428 has an insulation fault 434. The test lead 436 is connected to the cable 428 at the test pin 420. The insulation and resistance are determined by the controller 406 and shown in Tables 1 and 2 below.

TABLE 1

Phase C Insulation Fault Along Cable Insulation Test Results

| Insulation Test | Ground to Phase A | Ground to Phase B | Ground to Phase C | Phase A to B | Phase A to C | Phase B to C |
|---|---|---|---|---|---|---|
| No Jumper | OK | OK | No Insulation | OK | No Insulation | No Insulation |
| Jumper | No Insulation | No Insulation | No Insulation | No Insulation | No Insulation | No Insulation |

TABLE 2

Phase C Insulation Fault Along Cable Resistance Test Results

| Resistance Test | Ground to Phase A | Ground to Phase B | Ground to Phase C | Phase A to B | Phase A to C | Phase B to C |
|---|---|---|---|---|---|---|
| No Jumper | Open Circuit | Open Circuit | Open Circuit | ~2x Cable Resistance | Open Circuit | Open Circuit |
| Jumper | Open Circuit | Open Circuit | Open Circuit | Open Circuit | Open Circuit | Open Circuit |

Referring to FIG. 4B, the cable 428 has a continuity fault 438 in the electrical connection 132. The test lead 436 is connected to the cable 428 at the test pin 420. The insulation and resistance are determined by the controller 406 and shown in Tables 3 and 4 below.

TABLE 3

Phase C Insulation Fault In The Electrical Connection Test Results

| Insulation Test | Ground to Phase A | Ground to Phase B | Ground to Phase C | Phase A to B | Phase A to C | Phase B to C |
|---|---|---|---|---|---|---|
| No Jumper | OK | OK | No Insulation | OK | OK | OK |
| Jumper | No Insulation | No Insulation | No Insulation | No Insulation | No Insulation | No Insulation |

TABLE 3

Phase C Insulation Fault In The Electrical Connection Test Results

| Resistance Test | Ground to Phase A | Ground to Phase B | Ground to Phase C | Phase A to B | Phase A to C | Phase B to C |
|---|---|---|---|---|---|---|
| No Jumper | Open Circuit | Open Circuit | Open Circuit | ~2x Cable Resistance | Open Circuit | Open Circuit |
| Jumper | Open Circuit | Open Circuit | Open Circuit | Open Circuit | Open Circuit | Open Circuit |

Figure 5:
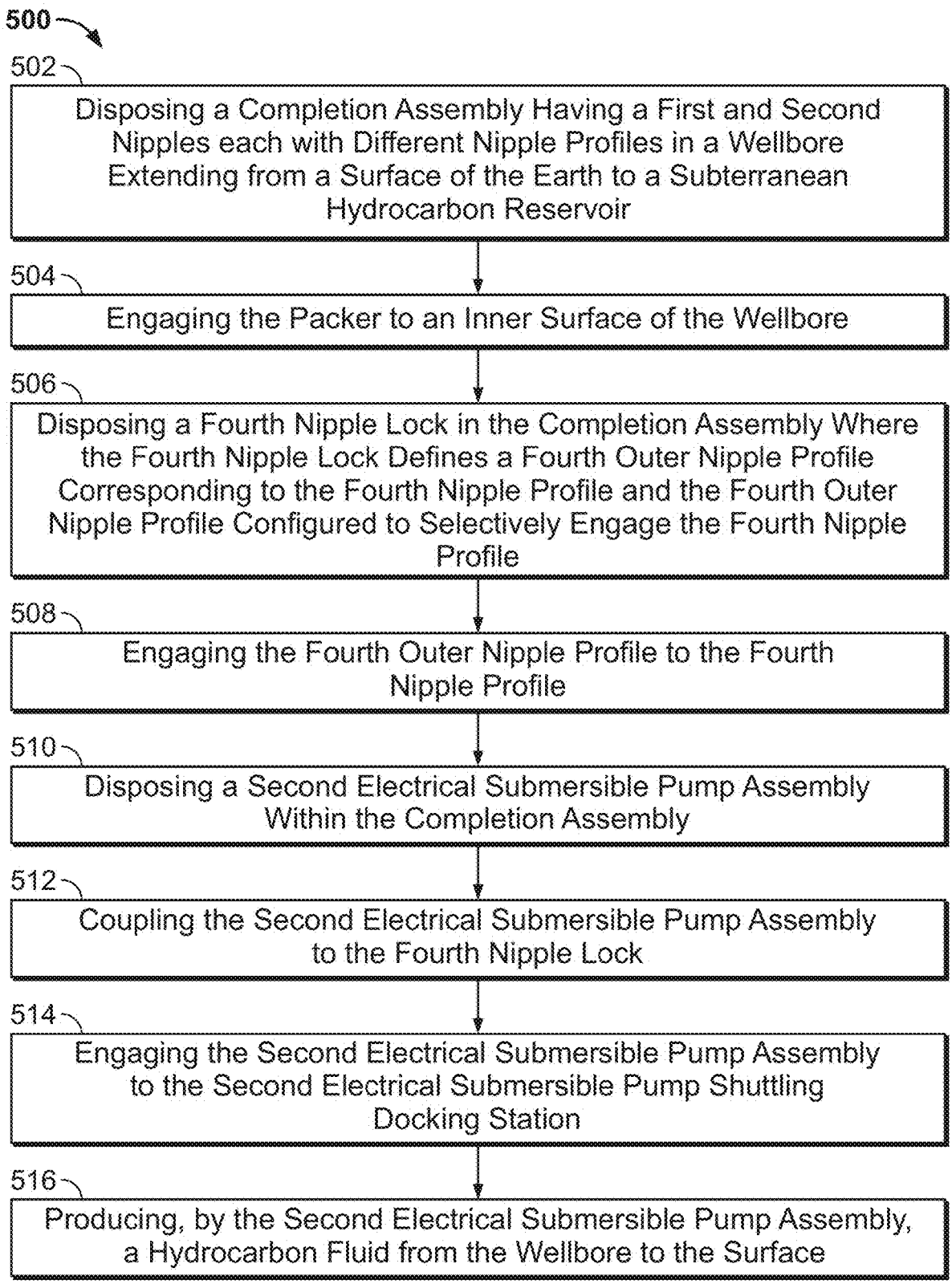
FIG. 5 is a flow chart of an example method of completing a wellbore according to the implementations of the present disclosure.

FIG. 5 is a flow chart of an example method of completing a wellbore according to the implementations of the present disclosure. The method 500 is described with reference to the completion assembly 102 shown in FIGS. 1-4B, but can be implemented with any other suitable completion assembly.

At 502, a completion assembly is disposed in the wellbore. The wellbore extends from a surface of the Earth to a subterranean hydrocarbon reservoir. The completion includes a first production tubing section, a first nipple, a first electrical submersible pump shuttle docking station, a first power cable, a second nipple, a second production tubing section, a third nipple, a second electrical submersible pump shuttle docking station, a second power cable, a fourth nipple, and a packer. The first production tubing section extends to the surface of the Earth and is coupled to the first nipple. The first nipple defines a first nipple profile. The first nipple is configured to receive a first nipple lock defining a first outer nipple profile corresponding to the first nipple profile. The first electrical submersible pump shuttle docking station is coupled to the first nipple. The first power cable is coupled to the first electrical submersible pump shuttle docking station and extends from the first electrical submersible pump shuttle docking station to the surface. The first electrical submersible pump shuttle docking station is configured to receive and supply power to a first electrical submersible pump assembly. The second nipple is coupled to the first electrical submersible pump shuttle docking station and defines a second nipple profile different than the first nipple profile. The second nipple is configured to receive a second nipple lock defining a second outer nipple profile corresponding to the second nipple profile. The second production tubing section is coupled to the second nipple. The third nipple is coupled to the second production tubing section and defines a third nipple profile different than the first nipple profile and the second nipple profile. The third nipple is configured to receive a third nipple lock defining a third outer nipple profile corresponding to the third nipple profile. The third nipple is spaced apart from the second nipple by the second production tubing section. The second electrical submersible pump shuttle docking station is coupled to the third nipple. The second electrical submersible pump shuttle docking station is configured to receive a second electrical submersible pump assembly. The second power cable is coupled to the second electrical submersible pump shuttle docking station. The second power cable extends from the second electrical submersible pump shuttle docking station to the surface. The fourth nipple is coupled to the second electrical submersible pump shuttle docking station. The fourth nipple defines a fourth nipple profile. The fourth nipple is configured to receive a fourth nipple lock defining a fourth outer nipple profile corresponding to the fourth nipple profile. The packer is coupled to the fourth nipple and positioned at a downhole end of the completion assembly. For example, referring to FIG. 1, the completion assembly 102 can be positioned in the wellbore 104 by the downhole conveyance.

At 504, the packer is engaged to an inner surface of the wellbore. For example, referring to FIG. 1, the packer 138 is actuated to couple the completion assembly 102 to the inner surface 140 of the casing 114.

At 506, a fourth nipple lock is disposed in the completion assembly. The fourth nipple lock defines the fourth outer nipple profile corresponding to the fourth nipple profile. The fourth outer nipple profile selectively engages the fourth nipple profile. For example, referring to FIG. 1, in this implementation, the second nipple lock 162 is disposed in the completion assembly 102 by the downhole conveyance.

At 508, the fourth outer nipple profile is engaged to the fourth nipple profile. For example, referring to FIG. 1, in this implementation, the second outer nipple profile 170 of the second nipple lock 162 is engaged to the second nipple profile 166 of the second nipple 134.

At 510, the second electrical submersible pump assembly is disposed within the completion assembly. For example, referring to FIG. 1, the electrical submersible pump assembly 126 is tripped into the completion assembly 102 in a downhole direction 146 by the downhole conveyance.

At 512, the second electrical submersible pump assembly is coupled to the fourth nipple lock. For example, referring to FIG. 1, the electrical submersible pump assembly is placed on the second surface 198 (an outer upper surface of the landing profile 182).

At 514, the second electrical submersible pump assembly is engaged to the first electrical submersible pump shuttling docking station. For example, referring to FIG. 1, the electrical submersible pump assembly 126 is engaged to the second electrical connection 136.

At 516, a hydrocarbon fluid is produced by the first electrical submersible pump assembly and flows from the wellbore to the surface. For example, the hydrocarbon fluids contained in the hydrocarbon reservoir 110 flow into the wellbore 104 and through the completion assembly 102 as the electrical submersible pump assembly 126 increases the pressure of the hydrocarbon fluids.

In some implementations, completing the wellbore includes sealing, by a sleeve, the first electrical submersible pump shuttle docking station from an inner volume of the completion assembly. For example, the sleeve 148 can be engaged to the completion assembly by the first nipple lock 144 and the third nipple lock 181. The void 143 is then defined and separated from the inner volume of the completion assembly 102.

In some implementations, completing the wellbore includes reducing a corrosion rate within a volume defined by the sleeve and the second electrical submersible pump shuttle docking station. For example, referring to FIG. 1, the corrosion protector 145 can reduce the corrosion in the void 143 and on the first electrical connection 132 (i.e., the first electrical submersible pump shuttle docking station).

In some implementations, completing the wellbore includes, responsive to a change in temperature of the sleeve, adjusting the sleeve. For example, referring to FIG. 1, responsive to the change in temperature the thermal compensation device 141 can adjust the sleeve 148 to maintain the sealing properties of the sleeve 148 by keeping the sleeve 148 coupled to the first electrical connection 132.

In some implementations, completing the wellbore includes disposing an electrical test tool in the wellbore using a downhole conveyance that is coupled to a running tool connector where the electrical test tool has a common jumper lead coupled to the running tool connector and the common jumper lead includes pins configured to engage the first electrical submersible pump shuttle docking station; coupling the electrical test tool to first electrical submersible pump shuttle docking station; determining, based on a condition of the common jumper lead, the condition of first electrical submersible pump shuttle docking station indicating a failure of first electrical submersible pump shuttle docking station; based on determining the condition of first electrical submersible pump shuttle docking station indicating the failure of first electrical submersible pump shuttle docking station, removing the first electrical submersible pump assembly from the completion assembly; disposing a third nipple lock in the completion assembly at the third nipple, the third nipple lock defining a third landing profile corresponding to the third nipple profile, the third landing profile configured to selectively engage the third nipple profile; engaging the third landing profile to the third nipple profile; disposing a second electrical submersible pump assembly within the completion assembly; coupling the second electrical submersible pump assembly to the third nipple lock; engaging the second electrical submersible pump assembly to the second electrical submersible pump shuttling docking station; and producing, by the second electrical submersible pump assembly, a hydrocarbon fluid from the wellbore to the surface. For example, referring to FIGS. 1 and 4A-4B, the side pocket mandrel electrical test tool 400 can be used to determine the location and type of fault in the first electrical connection 132, the second electrical connection 136, and/or the downhole power cables 124.

Figure 6:
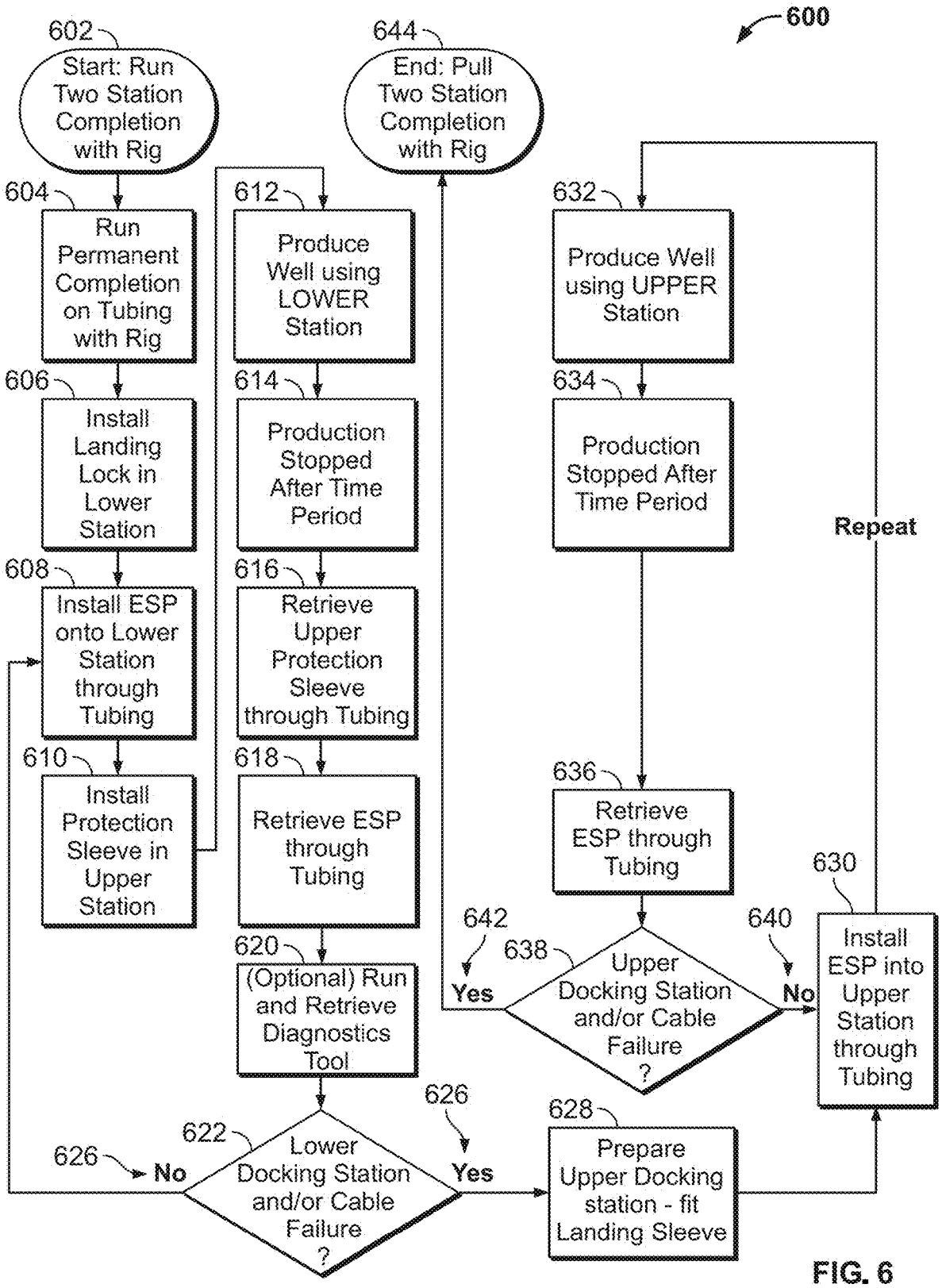
FIG. 6 is a flow chart of an example method of installing a completion assembly and producing a wellbore with an electrical submersible pump assembly at a lower docking station of the completion assembly according to the implementations of the present disclosure.

FIG. 6 is a flow chart of an example method 600 of installing a completion assembly and producing a wellbore with an electrical submersible pump assembly at a lower docking station of the completion assembly according to the implementations of the present disclosure. The method 600 is described with reference to the completion assembly 102 shown in FIGS. 1 and 4A-4B, but can be implemented with any other suitable completion assembly. In this implementation, the lower docking station is the second electrical connection 136 and the upper docking station is the first electrical connection 132.

At 602, the installation procedure starts by installing a completion assembly with two stations for electrical submersible pump assemblies using a drilling rig or a workover rig in a wellbore. For example, referring to FIG. 1, the completion assembly 102 can be positioned in the wellbore 104.

At 604, the permanent completion on tubing is run in the wellbore with the rig. For example, referring to FIG. 1, the production tubing section 128*a* and other components located uphole from the third nipple 185 can be disposed in the wellbore 104 and coupled to the third nipple 185.

At 606, the landing lock is installed at the lower station. For example, referring to FIG. 1, the second nipple lock 162 is coupled to the second nipple 134, below the second electrical connection 136.

At 608, the electrical submersible pump assembly is installed into the lower station through the tubing. For example, referring to FIG. 1, the rig disposes the electrical submersible pump assembly 126 within the completion assembly 102 and lowers the electrical submersible pump assembly 126 to contact the second nipple lock 162 and engages the plug arm 184 to the second electrical connection 136. The downhole conveyance is then removed from the completion assembly 102.

At 610, the protection sleeve is installed in the upper station. For example, referring to FIG. 1, the sleeve 148 is coupled to first and third nipple locks 144 and 181, and then the third nipple lock 181 is coupled to the downhole conveyance. The first nipple lock 144, the sleeve 148, and the third nipple locks 144 are tripped into the wellbore 104 to the first electrical connection 132. The first and third nipple locks 144, 181 are engaged to the first and third nipples 130, 185.

At 612, the wellbore is produced using the lower station. For example, referring to FIG. 1, the electrical submersible pump assembly 126 is energized to pressurize and flow the reservoir fluids from the downhole location 112 through the production tubing section **128*d* to the electrical submersible pump assembly 126 and up to the surface 106 through the completion assembly 102**.

At 614, after a period of time, production is stopped. For example, referring to FIG. 1, the electrical submersible pump assembly 126 may fail, or the operator may desire to reduce production downtime by replacing the electrical submersible pump assembly 126 before failure based on an estimated mean time between failure for electrical submersible pump assemblies.

At 616, the upper protection sleeve is retrieved through the tubing. For example, referring to FIG. 1, a downhole conveyance such as a slickline assembly, a wireline assembly, or a coiled tubing assembly can be tripped into the completion assembly 102 and coupled to the first nipple lock 144, the sleeve 148, and the third nipple locks 144. The downhole conveyance can remove the first nipple lock 144, the sleeve 148, and the third nipple locks 144 from the completion assembly 102.

At 618, the electrical submersible pump assembly is retrieved through the tubing. For example, referring to FIG. 1, the downhole conveyance is placed back into the completion assembly 102. The downhole conveyance is coupled to the electrical submersible pump assembly 126 and removed, by the downhole conveyance, from the completion assembly 102.

At 620, optionally, a diagnostic tool is run into the completion assembly, the electrical components are tested, and the diagnostic tool is retrieved. For example, referring to FIGS. 1 and 4A-4B, the side pocket mandrel electrical test tool 400 can be placed in the completion assembly 102 by the downhole conveyance and coupled to the second electrical connection 136 to determine the location and type of fault in one or more of the second electrical connection 136 and/or the downhole power cable 124 connected to the second electrical connection 136.

At 622, the diagnostic tool tests the lower docking station and/or cable for failure. When no failure of the lower docking station and the cable is indicated (a "No" condition), the process moves to step 624. At 624, with no failure of the lower docking station and the cable indicated, the process returns to step 608 and another new electrical submersible pump assembly 126 is installed at the lower station. When a failure of the lower docking station and the cable is not indicated (a "Yes" condition), the process continues to step 626. At 626, with a failure indicated at either the lower docking station and/or the cable, the process continues to step 628.

At 628, the upper docking station is prepared by fitting a landing lock. For example, referring to FIG. 1, another first nipple lock 144 having the landing profile 182 (described in reference to the second nipple lock 162) is placed in the completion assembly 102 and coupled to the first nipple 130.

At 630, an electrical submersible pump assembly is installed through the tubing and into the upper station. For example, referring to FIG. 1, a second electrical submersible pump assembly 126 is engaged to the first electrical connection 132.

At 632, the wellbore is produced using the upper station. For example, referring to FIG. 1, the second electrical submersible pump assembly 126 at the first electrical connection 132 is energized to pressurize and flow the reservoir fluids from the downhole location 112 through the through the completion assembly 102 and up to the surface 106.

At 634, after a period of time, production is stopped. For example, referring to FIG. 1, the second electrical submersible pump assembly 126 may fail, or the operator may desire to replace the second electrical submersible pump assembly 126 before failure based on an estimated mean time between failure for electrical submersible pump assemblies to reduce production downtime. In some cases, the operator may desire to perform enhanced oil recovery operations on the hydrocarbon reservoir 110 to increase hydrocarbon fluid output, extend the wellbore 104, drill one or more lateral wellbores from the wellbore 104 (a primary wellbore or motherbore), or plug and abandon the wellbore 104.

At 636, the second electrical submersible pump assembly 126 is retrieved through the tubing. For example, referring to FIG. 1, the downhole conveyance is placed back into the completion assembly 102. The downhole conveyance is coupled to the second electrical submersible pump assembly 126 and the second electrical submersible pump assembly 126 is removed, by the downhole conveyance, from the completion assembly 102.

At 638, the diagnostic tool tests the lower docking station and/or cable for failure. The diagnostic tool is run into the completion assembly, the electrical components are tested, and the diagnostic tool is retrieved. For example, referring to FIGS. 1 and 4A-4B, the side pocket mandrel electrical test tool 400 can be placed in the completion assembly 102 by the downhole conveyance and coupled to the first electrical connection 132 to determine the location and type of fault in one or more of the first electrical connection 132 and/or the downhole power cable 124 connected to the first electrical connection 132. When no failure of the upper docking station and the cable is indicated (a "No" condition), the process moves to step 640. At 640, with no failure of the upper docking station and the cable indicated, the process returns to step 630 and another new electrical submersible pump assembly 126 is installed at the upper station (the first electrical connection 132). When a failure of the upper docking station and the cable is not indicated (a "Yes" condition), the process continues to step 642. At 642, with a failure indicated at either the upper docking station and/or the cable, the process continues to step 644.

At 644, when no functioning electrical connections 132, 136 or downhole power cables 124 remain in the completion assembly 102, and/or the operator no longer desires to produce hydrocarbon fluids from the hydrocarbon reservoir 110, completing the wellbore by the method 600 terminates by pulling the two station completion with a rig, such as workover rig. Alternatively or in addition, the wellbore 104 can then be plugged and abandoned, or re-entry for enhanced oil recovery or for additional drilling and completing operations may be performed. Although the example method 600 of producing the wellbore 104 is described in reference to only two electrical connections 132, 136, when additional electrical connections are included in the completion assembly 102, either uphole or downhole, or both, from the two electrical connections 132, 136, this process can continue to place one or more additional electrical submersible pump assemblies 126 at the other electrical connections as desired by the operator.

Figure 7:
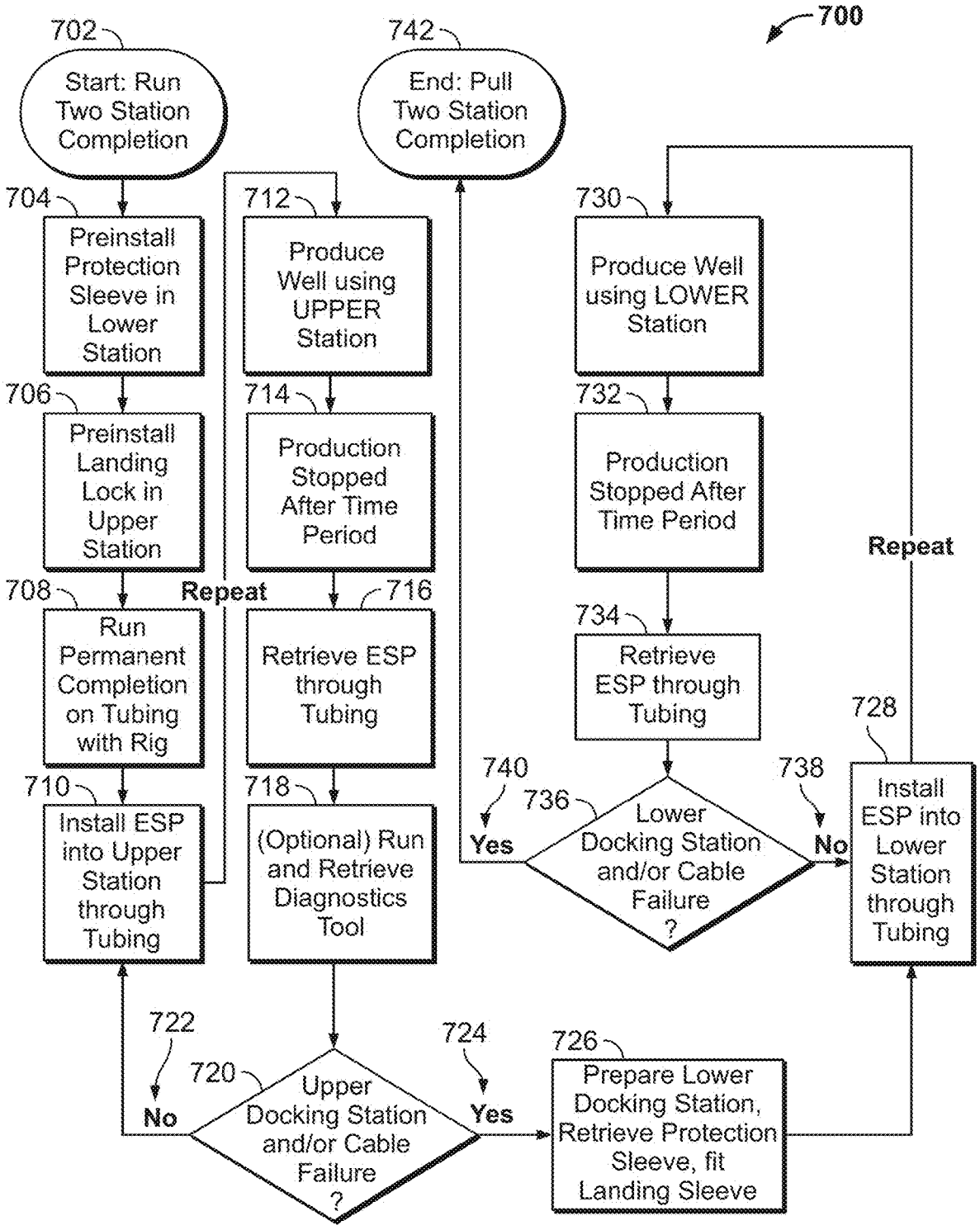
FIG. 7 is a flow chart of an example method of producing a wellbore with an electrical submersible pump assembly at an upper docking station of a previously installed completion assembly according to the implementations of the present disclosure.

FIG. 7 is a flow chart of an example method 700 of producing the wellbore 104 with an electrical submersible pump assembly 126 at an upper docking station (the first electrical connection 132) of a previously installed completion assembly 102. In method 700, production is started with the upper docking station (the first electrical connection 132). The method 700 is described with reference to the completion assembly 102 shown in FIGS. 1 and 4A-4B, but can be implemented with any other suitable completion assembly.

At 702, the installation procedure starts by preparing a completion assembly having two stations for electrical submersible pump assemblies. For example, referring to FIG. 1, the completion assembly 102 is assembled at the surface 106.

At 704, the protection sleeve is installed in the upper station. For example, referring to FIG. 1, at the surface 106, the sleeve 148 is coupled to the first and third nipple locks 144 and 181 at the second electrical connection 136. The first and third nipple locks 144, 181 are engaged to the second and fourth nipples 134, 185.

At 706, at the surface 106, the landing lock is installed at the upper station. For example, referring to FIG. 1, the second nipple lock 162 is coupled to the first nipple 130, below the first electrical connection 132.

At 708, the permanent completion on tubing is run in the wellbore with the rig (a drilling rig or a workover rig). For example, referring to FIG. 1, the completion assembly 102 with the pre-installed sleeve 148 and pre-installed second nipple lock 162 can be positioned in the wellbore 104. The packer 138 is actuated to couple the completion assembly 102 to the wellbore 104. The production tubing section 128*a* and other components uphole from the third nipple 185 can be disposed in the wellbore 104 and coupled to the third nipple 185, and the production tubing section 128*a* is coupled to the wellhead assembly 116.

At 710, the electrical submersible pump assembly is installed into the upper station through the tubing. For example, referring to FIG. 1, the rig disposes the electrical submersible pump assembly 126 within the completion assembly 102 and lowers the electrical submersible pump assembly 126 to contact the second nipple lock 162 at the first electrical connection 132 and engages the plug arm 184 to the first electrical connection 132. The downhole conveyance is then removed from the completion assembly 102.

At 712, the well is produced using the upper station. For example, referring to FIG. 1, the electrical submersible pump assembly 126 at the first electrical connection 132 is energized to pressurize and flow the reservoir fluids from the downhole location 112 through the completion assembly 102 and up to the surface 106.

At 714, after a period of time, production is stopped. For example, referring to FIG. 1, the electrical submersible pump assembly 126 may fail, or the operator may desire to replace the electrical submersible pump assembly 126 before failure based on an estimated mean time between failure for electrical submersible pump assemblies to reduce production downtime. In some cases, the operator may desire to perform enhanced oil recovery operations on the hydrocarbon reservoir 110 to increase hydrocarbon fluid output, extend the wellbore 104, drill one or more lateral wellbores from the wellbore 104, or plug and abandon the wellbore 104.

At 716, the electrical submersible pump assembly is retrieved through the tubing. For example, referring to FIG. 1, the downhole conveyance (a slickline assembly, a wireline assembly, or a coiled tubing assembly) is placed back into the completion assembly 102. The downhole conveyance is coupled to the electrical submersible pump assembly 126 and the electrical submersible pump assembly 126 is removed, by the downhole conveyance, from the completion assembly 102.

At 718, optionally, a diagnostic tool is run into the completion assembly, the electrical components are tested, and the diagnostic tool is retrieved. For example, referring to FIGS. 1 and 2A-2B, the side pocket mandrel electrical test tool 400 can be placed in the completion assembly 102 by the downhole conveyance and coupled to the first electrical connection 132 to determine the location and type of fault in one or more of the first electrical connection 132 and/or the downhole power cable 124 that is connected to the first electrical connection 132.

At 720, when no failure of the upper docking station and the cable is indicated (a "No" condition), the process moves to step 722. At 722, with no failure of the upper docking station and the cable indicated, the process returns to step 710 and another new electrical submersible pump assembly 126 is installed at the upper station (the first electrical connection 132). When a failure of the upper docking station and the cable is not indicated (a "Yes" condition), the process continues to step 724. At 724, with a failure indicated at either the lower docking station and/or the cable, the process continues to step 726.

At 726, the lower docking station is prepared by retrieving the protection sleeve and a landing sleeve is fitted. For example, referring to FIG. 1, the downhole conveyance can be tripped into the completion assembly 102 and coupled to the first nipple lock 144, the sleeve 148, and the third nipple locks 144. The downhole conveyance removes the first nipple lock 144, the sleeve 148, and the third nipple locks 144 from the completion assembly 102 and brings them to the surface. Another second nipple lock 162 having the landing profile 182 is placed in the completion assembly 102 and coupled to the second nipple 134. The lower docking station is prepared to receive an electrical submersible pump assembly 126.

At 728, the electrical submersible pump assembly is installed into the lower station through the tubing. For example, referring to FIG. 1, the downhole conveyance (a slickline assembly, a wireline assembly, or a coiled tubing assembly) disposes the electrical submersible pump assembly 126 within the completion assembly 102 and lowers the electrical submersible pump assembly 126 to contact the second nipple lock 162 and engages the plug arm 184 to the second electrical connection 136. The downhole conveyance is then removed from the completion assembly 102.

At 730, the well is produced using the lower station. For example, referring to FIG. 1, the electrical submersible pump assembly 126 is energized to pressurize and flow the reservoir fluids from the downhole location 112 through the production tubing section 128*d*, to the electrical submersible pump assembly 126 and up to the surface 106 through the completion assembly 102.

At 732, after a period of time, production is stopped. For example, referring to FIG. 1, the electrical submersible pump assembly 126 may fail, or the operator may desire to replace the electrical submersible pump assembly 126 before failure based on an estimated mean time between failure for electrical submersible pump assemblies to reduce production downtime.

At 734, the electrical submersible pump assembly is retrieved through the tubing. For example, referring to FIG. 1, the downhole conveyance is placed back into the completion assembly 102. The downhole conveyance is coupled to the electrical submersible pump assembly 126 and removes to the electrical submersible pump assembly 126 from the completion assembly 102.

At 736, the lower docking station and associated cable are tested for failure. For example, referring to FIGS. 1 and 4A-4B, the side pocket mandrel electrical test tool 400 is run into the completion assembly 102, the second electrical connection 136 and the respective downhole power cable 124 are tested, and the side pocket mandrel electrical test tool 400 is retrieved. The side pocket mandrel electrical test tool 400 can be placed in the completion assembly 102 by the downhole conveyance and coupled to the second electrical connection 136 to determine the location and type of fault in one or more of the second electrical connection 136 and/or the downhole power cable 124 connected to the second electrical connection 136. When no failure of the lower docking station and the cable is indicated (a "No" condition), the process moves to step 738. At 738, with no failure of the lower docking station and the cable indicated, the process returns to step 728 and another new electrical submersible pump assembly 126 is installed at the lower station (the second electrical connection 136). When a failure of the lower docking station and the cable is not indicated (a "Yes" condition), the process continues to step 740. At 740, with a failure indicated at either the lower docking station and/or the cable, the process continues to step 742.

At 742, when no functioning electrical connections 132, 136 or downhole power cables 124 remain in the completion assembly 102, or the operator no longer desires to produce hydrocarbon fluids from the hydrocarbon reservoir 110, completing the wellbore by the method 700 ends by pulling the two station completion with a rig, such as a workover rig. Alternatively, or in addition, the wellbore 104 can then be plugged and abandoned, or re-entry for enhanced oil recovery or for additional drilling and completing operations may be performed. Although the example method 700 of producing the wellbore 104 is described in reference to only two electrical connections 132, 136, when additional electrical connections are included in the completion assembly 102, either uphole or downhole, or both, from the two electrical connections 132, 136, this process can continue to place one or more additional electrical submersible pump assemblies 126 at the other electrical connections as desired by the operator.

Figure 8:
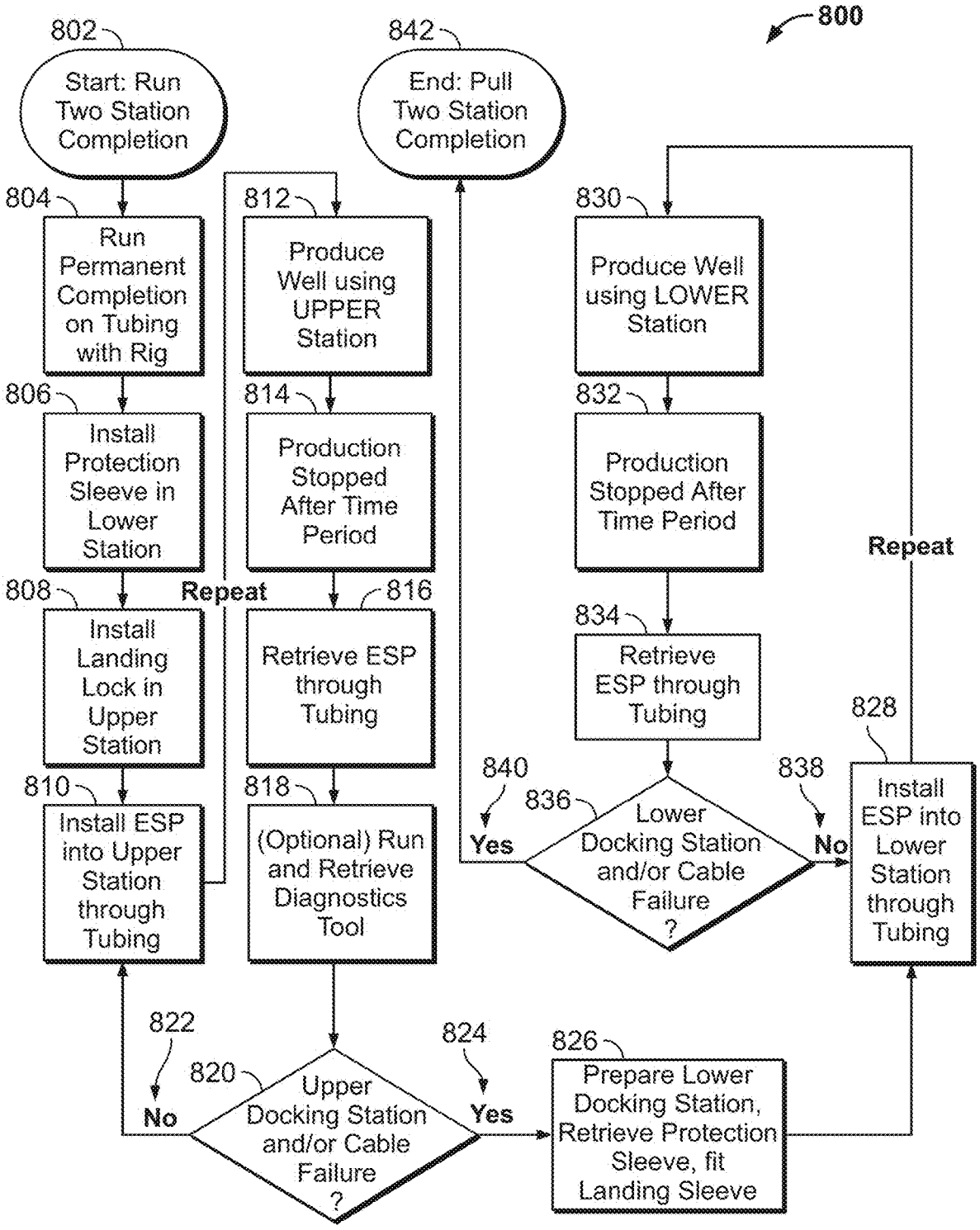
FIG. 8 is a flow chart of an example method of installing a completion assembly and producing a wellbore with an electrical submersible pump assembly at an upper docking station of the completion assembly according to the implementations of the present disclosure.

FIG. 8 is a flow chart of an example method 800 of installing the completion assembly 102 and producing the wellbore 104 with an electrical submersible pump assembly 126 at the upper docking station (the first electrical connection 132) of the completion assembly 102 according to the implementations of the present disclosure. Method 800 of completing and producing the wellbore 104 includes installing the completion assembly 102 with the electrical submersible pump assembly docking stations initially empty and where production will be started at the upper station.

At 802, the installation procedure starts by installing a completion assembly having two stations for electrical submersible pump assemblies with a drilling rig or a workover rig in a wellbore. For example, referring to FIG. 1, the completion assembly 102 can be positioned in the wellbore 104.

At 804, the permanent completion on tubing is run in the wellbore with the rig. For example, referring to FIG. 1, the production tubing section 128*a* and other components uphole from the third nipple 185 can be disposed in the wellbore 104 and coupled to the third nipple 185.

At 806, the protection sleeve is installed in the lower station. For example, referring to FIG. 1, the sleeve 148 is coupled to the first and third nipple locks 144 and 181, and then the third nipple lock 181 is coupled to the downhole conveyance. The first nipple lock 144, the sleeve 148, and the third nipple locks 144 are tripped into the wellbore 104 to the second electrical connection 136. The first and third nipple locks 144, 181 are engaged to the second and fourth nipples 134, 185.

At 808, the landing lock is installed at the upper station. For example, referring to FIG. 1, the second nipple lock 162 is coupled to the first nipple 130, below the first electrical connection 132.

At 810, an electrical submersible pump assembly is installed through the tubing and into the upper station. For example, referring to FIG. 1, a second electrical submersible pump assembly 126 is engaged to the first electrical connection 132. The electrical submersible pump assembly 126 is energized to pressurize and flow the reservoir fluids from the downhole location 112 through the completion assembly 102 and up to the surface 106.

At 812, after a period of time, production is stopped. For example, referring to FIG. 1, the electrical submersible pump assembly 126 may fail, or the operator may desire to replace the second electrical submersible pump assembly 126 before failure based on an estimated mean time between failures for electrical submersible pump assemblies to reduce production downtime. In some cases, the operator may desire to perform enhanced oil recovery operations on the hydrocarbon reservoir 110 to increase hydrocarbon fluid output, extend the wellbore 104, drill one or more lateral wellbores from the wellbore 104, or plug and abandon the wellbore 104.

At 814, the electrical submersible pump assembly 126 is retrieved through the tubing. For example, referring to FIG. 1, the downhole conveyance is placed back into the completion assembly 102. The downhole conveyance is coupled to the electrical submersible pump assembly 126 and the electrical submersible pump assembly 126 removed, by the downhole conveyance, from the completion assembly 102.

At 816, optionally, a diagnostic tool is run into the completion assembly, the electrical components are tested, and the diagnostic tool is retrieved. For example, referring to FIGS. 1 and 4A-4B, the side pocket mandrel electrical test tool 400 can be placed in the completion assembly 102 by the downhole conveyance and coupled to the first electrical connection 132 to determine the location and type of fault in one or more of the first electrical connection 132 and/or the downhole power cable 124 connected to the first electrical connection 132.

At 818, when no failure of the upper docking station and the cable is indicated (a "No" condition), the process moves to step 820. At 820, with no failure of the upper docking station and the cable indicated, the process returns to step 610 and another new electrical submersible pump assembly 126 is installed at the upper station (the first electrical connection 132). When a failure of the upper docking station and the cable is not indicated (a "Yes" condition), the process continues to step 822. At 822, with a failure indicated at either the lower docking station and/or the cable, the process continues to step 824.

At 824, the lower docking station is prepared by retrieving the protection sleeve and a landing sleeve is fitted. For example, referring to FIG. 1, the downhole conveyance can be tripped into the completion assembly 102 and coupled to the first nipple lock 144, the sleeve 148, and the third nipple locks 144. The downhole conveyance removes the first nipple lock 144, the sleeve 148, and the third nipple locks 144 from the completion assembly 102 and brings them to the surface. Another second nipple lock 162 having the landing profile 182 is placed in the completion assembly 102 and coupled to the second nipple 134. The lower docking station is prepared to receive an electrical submersible pump assembly 126.

At 826, the electrical submersible pump assembly is installed into the lower station through the tubing. For example, referring to FIG. 1, the downhole conveyance (a slickline assembly, a wireline assembly, or a coiled tubing assembly) disposes the electrical submersible pump assembly 126 within the completion assembly 102 and lowers the electrical submersible pump assembly 126 to contact the second nipple lock 162 and engages the plug arm 184 to the second electrical connection 136. The downhole conveyance is then removed from the completion assembly 102.

At 828, the well is produced using the lower station. For example, referring to FIG. 1, the electrical submersible pump assembly 126 is energized to pressurize and flow the reservoir fluids from the downhole location 112 through the production tubing section **128*d* to the electrical submersible pump assembly 126 and up to the surface 106 through the completion assembly 102**.

At 830, after a period of time, production is stopped. For example, referring to FIG. 1, the electrical submersible pump assembly 126 may fail, the operator may desire to replace the electrical submersible pump assembly 126 before failure based on an estimated mean time between failure for electrical submersible pump assemblies to reduce production downtime, or hydrocarbon fluids may no longer be arriving at the surface 106, even though the electricity appears be provided to the electrical submersible pump assembly 126, indicating a possible electrical failure in the system.

At 832, the electrical submersible pump assembly is retrieved through the tubing. For example, referring to FIG. 1, the downhole conveyance is placed back into the completion assembly 102. The downhole conveyance is coupled to the electrical submersible pump assembly 126 and the electrical submersible pump assembly 126 is removed, by the downhole conveyance, from the completion assembly 102.

At 834, the lower docking station and associated cable are tested for failure. For example, referring to FIGS. 1 and 4A-4B, the side pocket mandrel electrical test tool 400 is run into the completion assembly 102, the second electrical connection 136 and the respective downhole power cable 124 are tested, and the side pocket mandrel electrical test tool 400 is retrieved. The side pocket mandrel electrical test tool 200 can be placed in the completion assembly 102 by the downhole conveyance and coupled to the second electrical connection 136 to determine the location and type of fault in one or more of the second electrical connection 136 and/or the downhole power cable 124 connected to the second electrical connection 136. When no failure of the lower docking station and the cable is indicated (a "No" condition), the process moves to step 636. At 836, with no failure of the lower docking station and the cable indicated, the process returns to step 826 and another new electrical submersible pump assembly 126 is installed at the lower station (the second electrical connection 136). When a failure of the lower docking station and the cable is not indicated (a "Yes" condition), the process continues to step 838. At 838, with a failure indicated at either the lower docking station and/or the cable, the process continues to step 840.

At 840, when no functioning electrical connections 132, 136 or downhole power cables 124 remain in the completion assembly 102, or for some other reason the operator no longer desires to produce hydrocarbon fluids from the hydrocarbon reservoir 110, completing the wellbore by the method 800 ends by pulling the two station completion with a rig, such as workover rig. Alternatively or in addition, the wellbore 104 can then be plugged and abandoned, or re-entry for enhanced oil recovery or for additional drilling and completing operations may be performed. Although the example method 800 of producing the wellbore 104 is described in reference to only two electrical connections 132, 136, when additional electrical connections are included the completion assembly 102, either uphole or downhole, or both, from the two electrical connections 132, 136, this process can continue to place one or more additional electrical submersible pump assemblies 126 at the other electrical connections as desired by the operator.

Embodiments

In an example aspect, a wellbore completion assembly has a production tubing, a first nipple, a first electrical connection, a second nipple, and a second electrical connection. The first nipple is positioned at a first location in the production tubing and defines a first nipple profile. The first electrical connection is positioned at the first location. The first electrical connection is configured to couple to a first electrical submersible pump assembly. The second nipple is positioned at a second location in the production tubing. The second location is different than the first location. The second nipple defines a second nipple profile different than the first nipple profile. The second electrical connection is positioned at the second location. The second electrical connection is configured to couple to a second electrical submersible pump assembly.

In an example aspect combinable with any other example aspect, the wellbore completion assembly includes a first nipple lock. The first nipple lock has a first outer surface and a first outer nipple profile. The first outer nipple profile is defined in the first outer surface. The first outer nipple profile corresponds to the first nipple profile and is configured to selectively engage the first nipple profile of the first nipple.

In an example aspect combinable with any other example aspect, the wellbore completion assembly can include a second nipple lock. The second nipple lock has a second outer surface and a second outer nipple profile. The second outer nipple profile defined in the second outer surface, the second outer nipple profile different than the first outer nipple profile, the second outer nipple profile corresponding to the second nipple profile, the second outer nipple profile configured to selectively engage the second nipple profile of the second nipple.

In an example aspect combinable with any other example aspect, the second nipple lock includes a second landing profile. The second landing profile is configured to receive and support the second electrical submersible pump assembly within the wellbore completion assembly.

In an example aspect combinable with any other example aspect, the second nipple lock includes multiple annular flow ports. The annular flow ports pass a wellbore fluid through the second nipple lock from a first surface within the second nipple lock to an outer surface of the second nipple lock.

In an example aspect combinable with any other example aspect, the second nipple has a no-go diameter.

In an example aspect combinable with any other example aspect, the second nipple lock is configured to engage the second electrical submersible pump assembly to the second electrical connection when the second electrical submersible pump assembly is seated on the second nipple lock.

In an example aspect combinable with any other example aspect, the wellbore completion assembly includes a sleeve configured to couple to the first nipple lock. The sleeve is configured to seal the first electrical connection from a fluid within the production tubing.

In an example aspect combinable with any other example aspect, the sleeve includes a polished outer bore. The polished outer bore is configured to seal the first electrical connection from an inner void of the production tubing.

In an example aspect combinable with any other example aspect, the sleeve includes a corrosion protector.

In an example aspect combinable with any other example aspect, the sleeve includes a thermal compensation device. The thermal compensation device is configured to compensate for temperature expansion and contraction of a trapped volume between the sleeve and the first electrical connection.

In an example aspect combinable with any other example aspect, the wellbore completion assembly includes a third nipple and a third nipple lock. The third nipple is positioned at a third location in the production tubing. The third nipple defines a third nipple profile. The third location is proximal the first electrical connection. The third nipple lock has a third outer surface and a third outer nipple profile. The third outer nipple profile is defined in the first outer surface. The third outer nipple profile corresponds to the third nipple profile and is configured to selectively engage the third nipple profile.

In another example aspect, a wellbore is completed. Completing the wellbore includes disposing a completion assembly in the wellbore extending from a surface of the Earth to a subterranean hydrocarbon reservoir. The completion assembly includes a first production tubing section; a first nipple defining a first nipple profile, the first nipple coupled to the first production tubing section, the first nipple configured to receive a first nipple lock defining a first outer nipple profile; a first electrical submersible pump shuttle docking station coupled to the first nipple, the first electrical submersible pump shuttle docking station configured to receive a first electrical submersible pump assembly; a first power cable coupled to the first electrical submersible pump shuttle docking station, the first power cable extending from the first electrical submersible pump shuttle docking station to the surface; a second nipple coupled to the first electrical submersible pump shuttle docking station, the second nipple defining a second nipple profile different that the first nipple profile, the second nipple configured to receive a second nipple lock defining a second outer nipple profile; a second production tubing section coupled to the second nipple; a third nipple coupled to the second production tubing section, the third nipple defining a third nipple profile different than the first nipple profile and the second nipple profile, the third nipple spaced apart from the second nipple by the second production tubing section, the third nipple configured to receive a third nipple lock defining a third outer nipple profile; a second electrical submersible pump shuttle docking station coupled to the third nipple, the second electrical submersible pump shuttle docking station configured to receive a second electrical submersible pump assembly; a second power cable coupled to the second electrical submersible pump shuttle docking station, the second power cable extending from the second electrical submersible pump shuttle docking station to the surface; a fourth nipple coupled to the second electrical submersible pump shuttle docking station, the fourth nipple defining a fourth nipple profile, the fourth nipple configured to receive a fourth nipple lock defining a fourth outer nipple profile; and a packer positioned at a downhole end of the completion assembly. Completing the wellbore includes engaging the packer to an inner surface of the wellbore. Completing the wellbore includes disposing the second nipple lock in the completion assembly. The second nipple lock defines the second outer nipple profile corresponding to the second nipple profile. The second outer nipple profile is configured to selectively engage the second nipple profile. Completing the wellbore includes engaging the second outer nipple profile to the second nipple profile. Completing the wellbore includes disposing the second electrical submersible pump assembly within the completion assembly. Completing the wellbore includes coupling the second electrical submersible pump assembly to the fourth nipple lock. Completing the wellbore includes engaging the second electrical submersible pump assembly to the second electrical submersible pump shuttling docking station. Completing the wellbore includes producing, by the second electrical submersible pump assembly, a hydrocarbon fluid from the wellbore to the surface.

In an example aspect combinable with any other example aspect, completing the wellbore includes sealing, by a sleeve, the first electrical submersible pump shuttle docking station from an inner volume of the completion assembly.

In an example aspect combinable with any other example aspect, completing the wellbore includes reducing a corrosion rate within a volume defined by the sleeve and the first electrical submersible pump shuttle docking station. In an example aspect combinable with any other example aspect, completing the wellbore includes, responsive to a change in temperature of the sleeve, adjusting the sleeve.

In an example aspect combinable with any other example aspect, completing the wellbore includes disposing an electrical test tool in the wellbore by a downhole conveyance coupled to a running tool connector of the electrical test tool. The electrical test tool includes a common jumper lead coupled to the running tool connector. The common jumper lead has pins configured to engage the first electrical submersible pump shuttle docking station. Completing the wellbore includes coupling the electrical test tool to the first electrical submersible pump shuttle docking station; determining, based on a condition of the common jumper lead, a condition of first electrical submersible pump shuttle docking station indicating a failure of first electrical submersible pump shuttle docking station; based on determining the condition of first electrical submersible pump shuttle docking station indicating the failure of first electrical submersible pump shuttle docking station, removing the first electrical submersible pump assembly from the completion assembly; disposing a third nipple lock in the completion assembly at the third nipple, the third nipple lock defining a third landing profile corresponding to the third nipple profile, the third landing profile configured to selectively engage the third nipple profile; engaging the third landing profile to the third nipple profile; disposing a second electrical submersible pump assembly within the completion assembly; coupling the second electrical submersible pump assembly to the third nipple lock; engaging the second electrical submersible pump assembly to the second electrical submersible pump shuttling docking station; and producing, by the second electrical submersible pump assembly, a hydrocarbon fluid from the wellbore to the surface.

In yet another example aspect, a side pocket mandrel electrical test tool is configured to test a side pocket mandrel for powering an electrical submersible pump assembly in a wellbore. The side pocket mandrel electrical test tool has a running tool connector; a common jumper lead, and a controller. The common jumper lead is coupled to the running tool connector the common jumper lead having pins configured to engage an electrical connection of the side pocket mandrel for transmitting power to the electrical submersible pump assembly. The controller is electrically coupled to the common jumper lead. The controller performs operations including determining a condition of the electrical connection based on a condition of the common jumper lead.

In an example aspect combinable with any other example aspect, determining the condition of the electrical connection includes determining a first condition of the common jumper lead when the common jumper lead is not in contact with the electrical connection; determining a second condition of the common jumper lead when the common jumper lead is in contact with the electrical connection; comparing the first condition to the second condition; and based on a result of the comparison, determining the condition of the electrical connection.

In an example aspect combinable with any other example aspect, determining the condition of the electrical connection includes determining a location and a type of fault of the electrical connection.

In an example aspect combinable with any other example aspect, the condition of the electrical connection includes one or more of a condition of an insulation of an electrical submersible pump power cable, a resistance of the electrical connection, or a time domain reflectometry condition of the electrical connection.

Although the present implementations have been described in detail, it should be understood that various changes, substitutions, and alterations can be made hereupon without departing from the principle and scope of the disclosure. Accordingly, the scope of the present disclosure should be determined by the following claims and their appropriate legal equivalents.

The invention claimed is:

1. A wellbore completion assembly configured to support a first electrical submersible pump assembly and a second electrical submersible pump assembly, the wellbore completion assembly comprising:

a production tubing;

a first nipple positioned at a first location in the production tubing, the first nipple defining a first nipple profile, the first nipple configured to selectively receive a first nipple lock configured to support the first electrical submersible pump assembly at the first location within the wellbore completion assembly;

a first electrical connection at the first location, the first electrical connection configured to electrically couple to the first electrical submersible pump assembly;

a second nipple positioned at a second location in the production tubing, the second location different than the first location, the second nipple defining a second nipple profile different than the first nipple profile, the second nipple configured to selectively receive a second nipple lock configured to support the second electrical submersible pump assembly at the second location within the wellbore completion assembly; and a second electrical connection at the second location, the second electrical connection configured to electrically couple to the second electrical submersible pump assembly.

2. The wellbore completion assembly of claim 1, further comprising the first nipple lock, the first nipple lock configured to be run into the wellbore completion assembly separately from the first electrical submersible pump assembly, the first nipple lock comprising:

a first outer surface; and a first outer nipple profile defined in the first outer surface, the first outer nipple profile corresponding to the first nipple profile and configured to selectively engage the first nipple profile of the first nipple.

3. The wellbore completion assembly of claim 2, further comprising the second nipple lock, the second nipple lock configured to be run into the wellbore completion assembly separately from the second electrical submersible pump assembly, the second nipple lock comprising:

a second outer surface; and a second outer nipple profile defined in the second outer surface, the second outer nipple profile different than the first outer nipple profile, the second outer nipple profile corresponding to the second nipple profile, the second outer nipple profile configured to selectively engage the second nipple profile of the second nipple.

4. The wellbore completion assembly of claim 3, wherein the second nipple lock further comprises a second landing profile configured to receive and support the second electrical submersible pump assembly within the wellbore completion assembly, and the second nipple lock comprises a threaded outer surface configured to threadedly coupled to the production tubing.

5. The wellbore completion assembly of claim 3, wherein the second nipple lock comprises a plurality of annular flow ports configured to pass a wellbore fluid through the second nipple lock from a first surface within the second nipple lock to an outer surface of the second nipple lock.

6. The wellbore completion assembly of claim 3, wherein the second nipple comprises a no-go diameter.

7. The wellbore completion assembly of claim 3, wherein the second nipple lock is configured to engage the second electrical submersible pump assembly to the second electrical connection when the second electrical submersible pump assembly is seated on the second nipple lock.

8. The wellbore completion assembly of claim 2, further comprising a sleeve configured to couple to the first nipple lock, the sleeve configured to seal the first electrical connection from a fluid within the production tubing.

9. The wellbore completion assembly of claim 8, wherein the sleeve comprises a polished outer bore, the polished outer bore configured to seal the first electrical connection from an inner void of the production tubing.

10. The wellbore completion assembly of claim 8, wherein the sleeve further comprises a corrosion protector.

11. The wellbore completion assembly of claim 8, wherein the sleeve further comprises a thermal compensation device configured to compensate for temperature expansion and contraction of a trapped volume between the sleeve and the first electrical connection.

12. The wellbore completion assembly of claim 7, further comprising:

a third nipple positioned at a third location in the production tubing, the third nipple defining a third nipple profile, the third location proximal the first electrical connection; and a third nipple lock comprising:

a third outer surface; and a third outer nipple profile defined in the first outer surface, the third outer nipple profile corresponding to the third nipple profile and configured to selectively engage the third nipple profile.

13. A method of completing a wellbore, the method comprising:

disposing a completion assembly in the wellbore extending from a surface of the Earth to a subterranean hydrocarbon reservoir, the completion assembly comprising:

a first production tubing section;

a first nipple defining a first nipple profile, the first nipple coupled to the first production tubing section, the first nipple configured to receive a first nipple lock defining a first outer nipple profile;

a first electrical submersible pump shuttle docking station coupled to the first nipple, the first electrical submersible pump shuttle docking station configured to receive a first electrical submersible pump assembly;

a first power cable coupled to the first electrical submersible pump shuttle docking station, the first power cable extending from the first electrical submersible pump shuttle docking station to the surface;

a second nipple coupled to the first electrical submersible pump shuttle docking station, the second nipple defining a second nipple profile different that the first nipple profile, the second nipple configured to receive a second nipple lock defining a second outer nipple profile;

a second production tubing section coupled to the second nipple;

a third nipple coupled to the second production tubing section, the third nipple defining a third nipple profile different than the first nipple profile and the second nipple profile, the third nipple spaced apart from the second nipple by the second production tubing section, the third nipple configured to receive a third nipple lock defining a third outer nipple profile;

a second electrical submersible pump shuttle docking station coupled to the third nipple, the second electrical submersible pump shuttle docking station configured to receive a second electrical submersible pump assembly;

a second power cable coupled to the second electrical submersible pump shuttle docking station, the second power cable extending from the second electrical submersible pump shuttle docking station to the surface;

a fourth nipple coupled to the second electrical submersible pump shuttle docking station, the fourth nipple defining a fourth nipple profile, the fourth nipple configured to receive a fourth nipple lock defining a fourth outer nipple profile; and a packer positioned at a downhole end of the completion assembly;

engaging the packer to an inner surface of the wellbore;

disposing the second nipple lock in the completion assembly, the second nipple lock defining the second outer nipple profile corresponding to the second nipple profile, the second outer nipple profile configured to selectively engage the second nipple profile;

engaging the second outer nipple profile to the second nipple profile;

disposing the second electrical submersible pump assembly within the completion assembly;

coupling the second electrical submersible pump assembly to the fourth nipple lock;

engaging the second electrical submersible pump assembly to the second electrical submersible pump shuttle docking station; and producing, by the second electrical submersible pump assembly, a hydrocarbon fluid from the wellbore to the surface.

14. The method of claim 13, further comprising sealing, by a sleeve, the first electrical submersible pump shuttle docking station from an inner volume of the completion assembly.

15. The method of claim 14, further comprising:

reducing a corrosion rate within a volume defined by the sleeve and the first electrical submersible pump shuttle docking station; and responsive to a change in temperature of the sleeve, adjusting the sleeve.

16. The method of claim 14, further comprising:

disposing an electrical test tool in the wellbore by a downhole conveyance coupled to a running tool connector of the electrical test tool, the electrical test tool comprising a common jumper lead coupled to the running tool connector, the common jumper lead comprising pins configured to engage the first electrical submersible pump shuttle docking station;

coupling the electrical test tool to the first electrical submersible pump shuttle docking station;

determining, based on a condition of the common jumper lead, a condition of first electrical submersible pump shuttle docking station indicating a failure of first electrical submersible pump shuttle docking station;

based on determining the condition of first electrical submersible pump shuttle docking station indicating the failure of first electrical submersible pump shuttle docking station, removing the first electrical submersible pump assembly from the completion assembly;

disposing a third nipple lock in the completion assembly at the third nipple, the third nipple lock defining a third landing profile corresponding to the third nipple profile, the third landing profile configured to selectively engage the third nipple profile;

engaging the third landing profile to the third nipple profile;

disposing a second electrical submersible pump assembly within the completion assembly;

coupling the second electrical submersible pump assembly to the third nipple lock;

engaging the second electrical submersible pump assembly to the second electrical submersible pump shuttle docking station; and producing, by the second electrical submersible pump assembly, a hydrocarbon fluid from the wellbore to the surface.

17. The wellbore completion assembly of claim 3, wherein the first nipple profile is defined on an inner surface of the first nipple oriented toward a center axis of the first nipple, and wherein the second nipple profile is defined on an inner surface of the second nipple oriented toward a center axis of the second nipple.

18. A side pocket mandrel electrical test tool comprising:

a running tool connector;

a common jumper lead coupled to the running tool connector, the common jumper lead comprising pins configured to engage an electrical connection of a side pocket mandrel for an electrical submersible pump assembly; and a controller electrically coupled to the common jumper lead, the controller configured to perform operations comprising based on a condition of the common jumper lead, determining a condition of the electrical connection, wherein determining the condition of the electrical connection comprises:

determining a first condition of the common jumper lead when the common jumper lead is not in contact with the electrical connection;

determining a second condition of the common jumper lead when the common jumper lead is in contact with the electrical connection;

comparing the first condition to the second condition; and based on a result of the comparison, determining the condition of the electrical connection.

19. The side pocket mandrel electrical test tool of claim 18, wherein determining the condition of the electrical connection comprises determining a location and a type of fault of the electrical connection.

20. The side pocket mandrel electrical test tool of claim 18, wherein the condition of the electrical connection comprises one or more of a condition of an insulation of an electrical submersible pump power cable, a resistance of the electrical connection, or a time domain reflectometry condition of the electrical connection.

* * * * *